United States Patent [19]

Miyasaka et al.

[11] Patent Number: 4,859,576

[45] Date of Patent: Aug. 22, 1989

[54] SILVER HALIDE PHOTOGRAPHIC MATERIAL COMPRISING A PROTECTIVE LAYER CONTAINING A POLYOXYETHYLENE SURFACE ACTIVE AGENT

[75] Inventors: Nobuaki Miyasaka; Shigeki Yokoyama; Shuzo Suga; Takashi Naoi; Masaki Satake, all of Kanagawa, Japan

[73] Assignee: Fuji Photo Film Co., Ltd., Kanagawa, Japan

[21] Appl. No.: 178,796

[22] Filed: Mar. 29, 1988

Related U.S. Application Data

[63] Continuation of Ser. No. 829,040, Feb. 13, 1986, abandoned.

[30] Foreign Application Priority Data

Feb. 13, 1985 [JP] Japan ..... 60-24508
Feb. 13, 1985 [JP] Japan ..... 60-24509

[51] Int. Cl.[4] ..... G03C 1/76; G03C 1/82

[52] U.S. Cl. ..... 430/523; 430/527; 430/564; 430/611; 430/631; 430/637; 430/961

[58] Field of Search ..... 430/523, 961, 527, 564, 430/611, 637, 631

[56] References Cited

U.S. PATENT DOCUMENTS

| | | | |
|---|---|---|---|
| 3,063,838 | 11/1962 | Jennings | 430/523 |
| 3,271,158 | 9/1966 | Allentoff et al. | 430/567 |
| 3,397,987 | 8/1968 | Lucky et al. | 430/611 |
| 3,514,289 | 5/1970 | Goffe et al. | 430/631 |
| 4,272,616 | 6/1981 | Kishimoto | 430/637 |
| 4,369,248 | 1/1983 | Ranz et al. | 430/523 |
| 4,400,462 | 8/1983 | Ono et al. | 430/523 |
| 4,506,008 | 3/1985 | Sugimoto et al. | 430/509 |
| 4,518,354 | 5/1985 | Yokoyama et al. | 430/527 |
| 4,551,421 | 11/1985 | Sugimoto et al. | 430/509 |
| 4,558,001 | 12/1985 | Yokoyama et al. | 430/527 |

FOREIGN PATENT DOCUMENTS

| | | |
|---|---|---|
| 3405198 | 8/1984 | Fed. Rep. of Germany . |
| 1492132 | 5/1965 | France . |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A silver halide photographic material having a high covering power with improved pressure resistance and antistatic properties upon development, which comprises at least one silver halide photographic emulsion layer disposed on at least one side of a support, wherein at least one of the silver halide photographic emulsion layer(s) contains a photosensitive silver halide emulsion containing silver iodide and an internally fogged silver halide emulsion, and at least one of the silver halide photographic emulsion layer(s) and an auxiliary layer(s) which is disposed on the same side of the support as that of the support having said emulsion containing silver iodide contains at least one polyoxyethylenic surface active agent selected from the group consisting of compounds represented by formula (I) and (II)

(I)

(II)

wherein $R_1$, $R_2$, $R_6$, $R_8$, $R_{10}$, and $R_{12}$ each represents a hydrogen atom, a substituted or unsubstituted alkyl group, aryl group alkoxy group, or aryloxy group, a halogen atom, an acyl group, an amido group, a sulfonamido group, a carbamoyl group, or a sulfamoyl group, $R_5$, $R_7$, $R_9$ and $R_{11}$ each represents a substituted or unsubstituted alkyl group, aryl group alkoxy group, or aryloxy group, a halogen atom, an acyl group, an amido group, a sulfonamido group, a carbamoyl group, or a sulfamoyl group; $R_3$ and $R_4$ each represents a hydrogen atom, a substituted or unsubstituted alkyl group, aryl group, or heterocyclic aromatic ring, or groups in at least one combination of $R_3$ and $R_4$, $R_5$ and $R_6$, $R_7$ and $R_8$, $R_9$ and $R_{10}$, and $R_{11}$ and $R_{12}$ are connected to each other to form a substituted or unsubstituted ring; $n_1$, $n_2$, and $n_3$ each represents the average polymerization degree of ethylene oxide within the range of from 5 to 50; and m represents an average polymerization degree of from 5 to 50.

24 Claims, No Drawings

SILVER HALIDE PHOTOGRAPHIC MATERIAL COMPRISING A PROTECTIVE LAYER CONTAINING A POLYOXYETHYLENE SURFACE ACTIVE AGENT

This is a continuation of application Ser. No. 829,040 filed 2/13/86, now abandoned.

FIELD OF THE INVENTION

The present invention relates to a silver halide photographic material. More particularly, the present invention relates to a high covering power photographic material having improved pressure resistance and antistatic properties upon development.

BACKGROUND OF THE INVENTION

The covering power of silver halide emulsions is emulsion manufacturers' great concern because the use of an emulsion having a high covering power enables them to save the amount of silver required to attain a desired optical density. It is disclosed in U.S. Pat. Nos. 2,996,382, 3,178,282, 3,397,987, and 3,607,278, and British Pat. No. 1,426,277 that a remarkably high covering power of silver halide emulsion can be obtained by mixing a surface photosensitive emulsion having a high iodine content with an emulsion comprising small size internally fogged particles. It is further disclosed in Japanese Patent Publication No. 27065/69 (corresponding to U.S. Pat. No. 3,397,987) that the photosensitivity can be increased by adding a polyoxyethylene compound to a silver halide emulsion layer having the above composition.

The inventors have observed that when the abovedescribed polyoxyethylene compound is added to a silver halide emulsion layer comprising a surface photosensitive emulsion and an emulsion of internally fogged particles, the developing speed and the covering power of developed silver are increased. However, the photographic material thus prepared is disadvantageous in that when developed by means of a roller type automatic developing apparatus, it is susceptible to pressure-blackening (hereinafter referred to as "roller mark") by rollers. It is also disadvantageous in that when the above disclosed polyoxyethylene compound is used in a relatively large amount to lower the surface resistivity and improve the antistatic properties of the photographic material, its susceptibility to roller marks is further aggravated. In short, it has not so far been possible for anti-roller mark properties and the antistatic properties to be improved at the same time.

SUMMARY OF THE INVENTION

It is therefore an object of the present invenion to provide a silver halide photographic material having a high covering power of developed silver and an improved pressure resistance upon development.

It is another object of the present invention to provide a silver halide photographic material which provides a high coverage developing silver and having improved antistatic properties.

These and other objects of the present invention will become more apparent from the following detailed description and examples.

As a results of intensive studies to solve the above prior art disadvantages, the inventors have found that these objects can be accomplished by the following silver halide photographic material.

The present invention provides a silver halide photographic material comprising at least one silver halide photographic emulsion layer disposed on at least one side of a support, wherein at least one of the silver halide photogrpahic emulsion layer(s) contains a photosensitive silver halide emulsion containing silver iodide and an internally fogged silver halide emulsion, and at least one of the silver halide photographic emulsion layer(s) and an auxiliary layer(s) which is disposed on the same side of the support as that of the support having said emulsion containing silver iodide contains a polyoxyethylenic surface active agent selected from the group consisting of compounds represented by formulae (I) and (II):

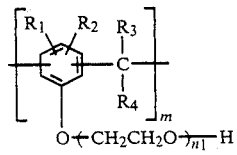

(I)

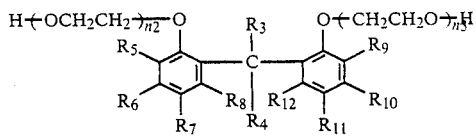

(II)

wherein $R_1$, $R_2$, $R_6$, $R_8$, $R_{10}$, and $R_{12}$ each represents a hydrogen atom, a substituted or unsubstituted alkyl gorup, aryl group, alkoxy group, or aryloxy group, a halogen atom, an acyl group, an amido group, a sulfonamido group, a carbamoyl group, or a sulfamoyl group; $R_5$, $R_7$, $R_9$, and $R_{11}$ each represents a substituted or unsubstituted alkyl group, aryl group, alkoxy group, or aryloxy group, a halogen atom, an acyl group, an amido group, a sulfonamido group, a carbamoyl group, or a sulfamoyl group; $R_3$ and $R_4$ each represents a hydrogen atom, a substituted or unsubstituted alkyl group, aryl group, or heterocyclic aromatic ring; $R_3$ and $R_4$, $R_5$ and $R_6$, $R_7$ and $R_8$, $R_9$ and $R_{10}$, and $R_{11}$ and $R_{12}$ being optionally connected to each other to form a substituted or unsubstituted ring; $n_1$, $n_2$, and $n_3$ each represents the average polymerization degree of ethylene oxide within the range of from 5 to 50; and m represents an average polymerization degree of from 5 to 50.

DETAILED DESCRIPTION OF THE INVENTION

In formulae (I) and (II), $R_1$, $R_2$, $R_5$, $R_6$, $R_7$, $R_8$, $R_9$, $R_{10}$, $R_{11}$, and $R_{12}$ each preferably represents a substituted or unsubstituted alkyl group having from 1 to 20 carbon atoms, such as methyl, ethyl, i-propyl, t-butyl, t-amyl, t-hexyl, t-oxtyl, nonyl, decyl, dodecyl, trichloromethyl, tribromomethyl, 1-phenylethyl, and 2-phenyl-2-propyl, a substituted or unsubstituted aryl group having from 6 to 20 carbon atoms such as phenyl group and p-chlorophenyl group, a substituted or unsubstituted alkoxy group represented by the formula —$OR_{15}$ wherein $R_{15}$ represents a substituted or unsubstituted alkyl group having from 1 to 20 carbon atoms, a substituted or unsubstituted aryl group having from 6 to 20 carbon atoms, or a substituted or unsubstituted aralkyl group having from 7 to 20 carbon atoms (examples for substituents for $R_{15}$ include a halogen atom, an aryl group, an alkoxy group, and an acylamino group), a halogen atom such as chlorine atom and bromine atom, an acyl group represented by the formula —$COR_{15}$, an amido group represented by the formula —$NR_{16}COR_{15}$, a sulfonamido group represented by the formula —$NR_{16}SO_2R_{15}$, a carbamoyl group represented by the formula

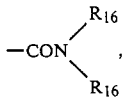

or a sulfamoyl group represented by the formula

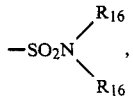

wherein $R_{15}$ is as defined above and $R_{16}$ is a hydrogen atom or an alkyl group having from 1 to 20 carbon atoms, $R_1$, $R_2$, $R_6$, $R_8$, $R_{10}$, and $R_{12}$ may each be a hydrogen atom. In particular, $R_5$, $R_7$, $R_9$, and $R_{11}$ each is preferably an alkyl group or halogen atom, more preferably a tertiary alkyl group which is bulky such as t-butyl group, t-amyl group, and t-octyl group. $R_6$, $R_8$, $R_{10}$, and $R_{12}$ each is more preferably a hydrogen atom. That is, a compound of formula (I) prepared from 2,4-di-substituted phenol is most preferable.

$R_3$ and $R_4$ each is preferably a hydrogen atom, substituted or unsubstituted alkyl group (examples for substituents for the alkyl group include a halogen atom, an aryl group, an alkoxy group, and an acylamino group) such as methyl group, ethyl group, n-propyl group, i-propyl group, n-heptyl group, 1-ethylamyl group, n-undecyl group, trichloromethyl group, and tribromomethyl group, or a substituted or unsubstituted aryl group such as α-furyl group, phenyl group, naphthyl group, p-chlorophenyl group, p-methoxyphenyl group, and m-nitrophenyl group. $R_3$ and $R_4$ each may be a 5- or 6-membered heterocyclic ring having, for example, —O—, —NH—, or —S— in the ring.

$R_3$ and $R_4$, $R_5$ and $R_6$, $R_7$ and $R_8$, $R_9$ and $R_{10}$, and $R_{11}$ and $R_{12}$ may be optionally connected to each other to form a substituted or unsubstituted ring, for example, a 5- or 6-membered cycloalkyl group or an aryl group, such as a cyclohexyl ring and a condensed benzene ring (examples for substituents for these rings include a halogen atom, an aryl group, an alkoxy group, and an acylamino group). In particular, $R_3$ and $R_4$ each is preferably a hydrogen atom, an alkyl group having from 1 to 8 carbon atoms, phenyl group, or furyl group. $n_1$, $n_2$, and $n_3$ each is most preferably a number of from 5 to 30. $n_2$ and $n_3$ may be the same to or different from each other. When $n_1$, $n_2$ and $n_3$ is less than 5 the effects of the present invention is not sufficient, while when they are more than 100 it is not preferable from viewpoint of occurence of side effects. Furthermore, it is not preferable that the agent contains a compound having an extremely small polymerization degree because it tends to reduce photographic sensitivity, and it also is not preferable that the compound contains a compound having an extremely large polymerization degree from viewpoint of reduction of solubility.

In formula (I), $R_1$ and $R_2$ each preferably bonds to 2-, 3-, or 4-position of the benzene ring, and

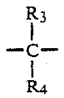

preferably bonds to 1- and 5-positions of the benzene ring.

Among compounds represented by formulae (I) and (II) compounds represented by formula (I) are preferably used. Two or more compounds represented by formula (I) and (II) may be used in combination.

Examples of the polyoxyethylenic surface active agent of the present invention include the following compounds:

I-1

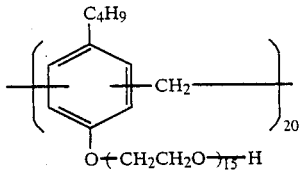

I-2

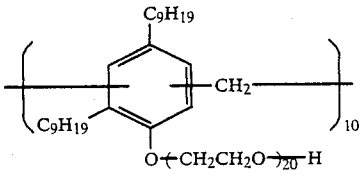

I-3

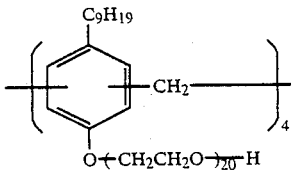

I-4

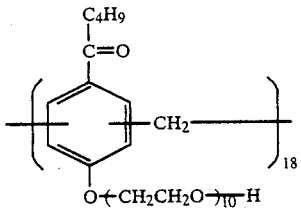

I-5

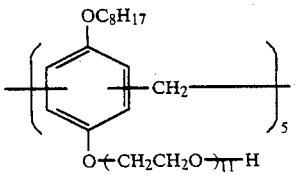

I-6

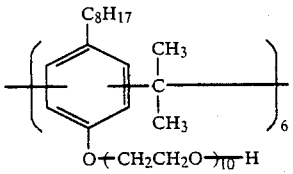

-continued
I-7
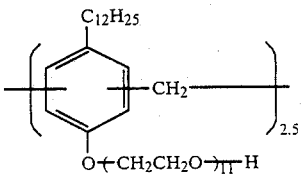
II-8
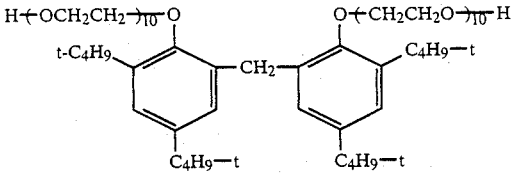
II-9
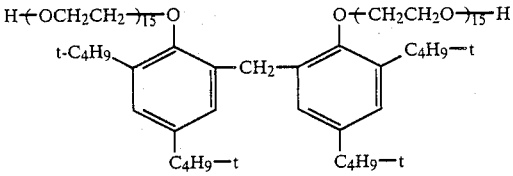
II-10
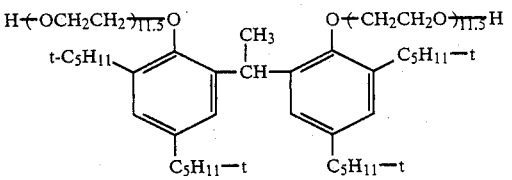
II-11
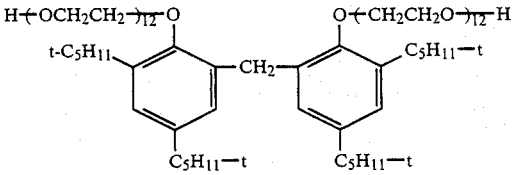
II-12
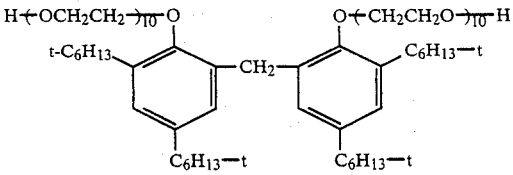
II-13
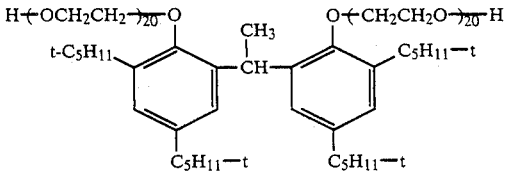
II-14
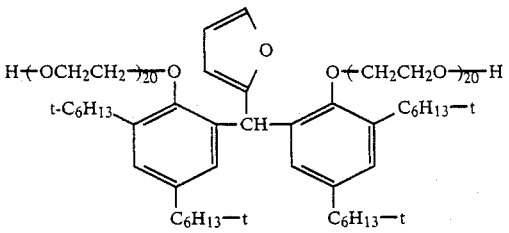
-continued
II-15
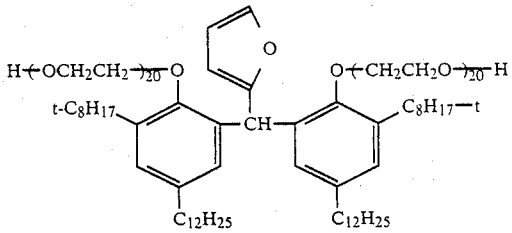
II-16
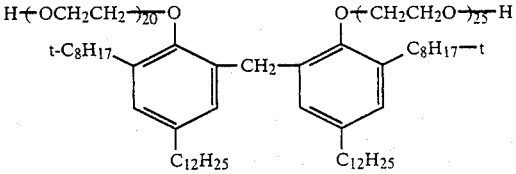
II-17
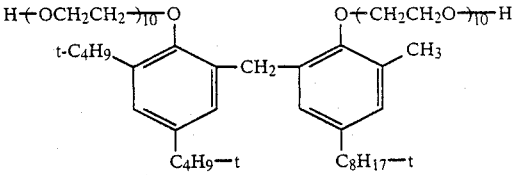
II-18
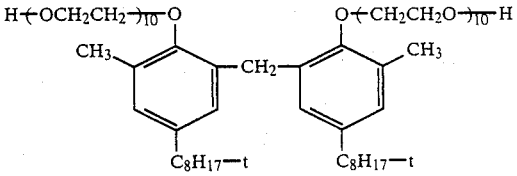
II-19
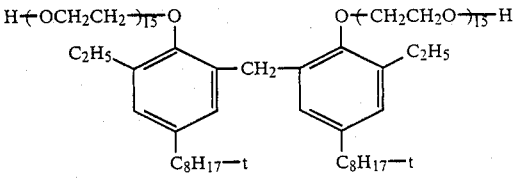
II-20
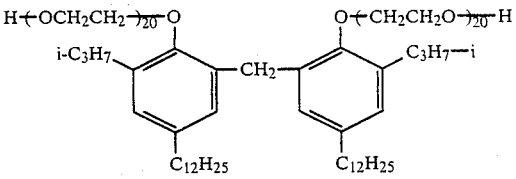
II-21
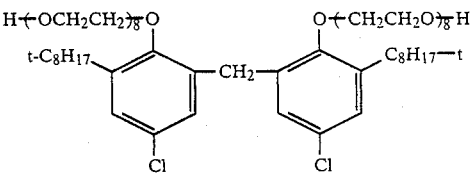
II-22
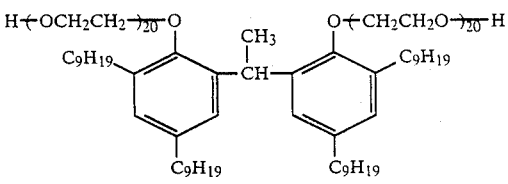

-continued
II-23
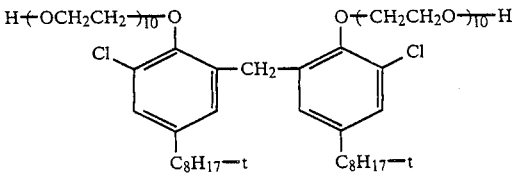
II-24
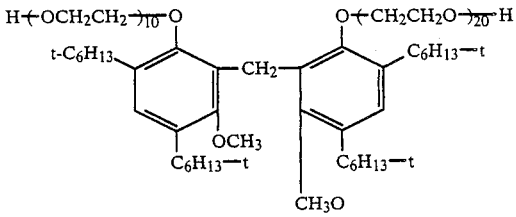
II-25
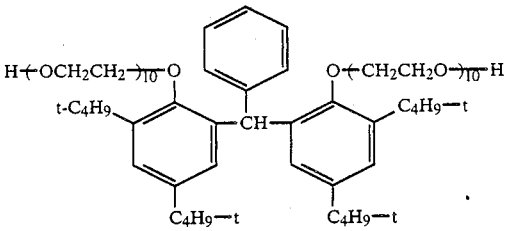
II-26
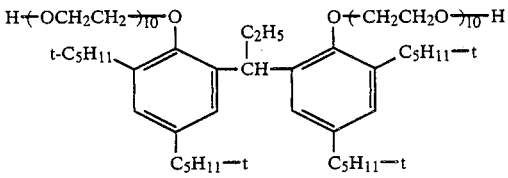
II-27
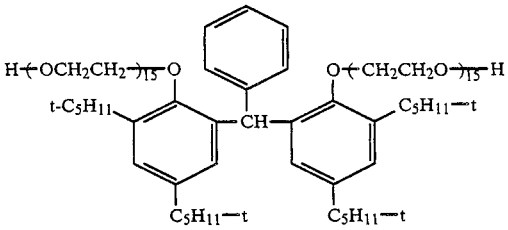
II-28
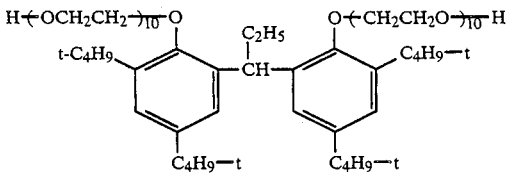
II-29
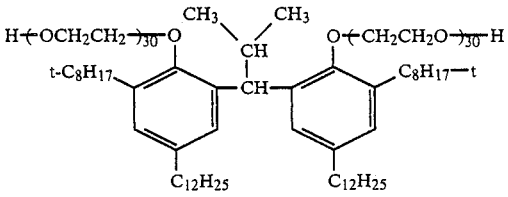
II-30
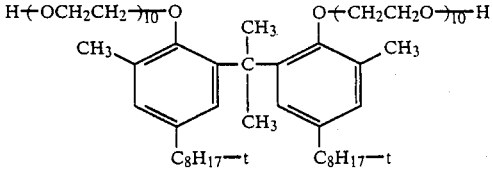
-continued
II-31
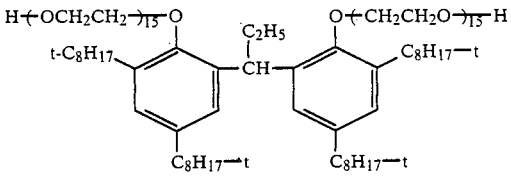
II-32
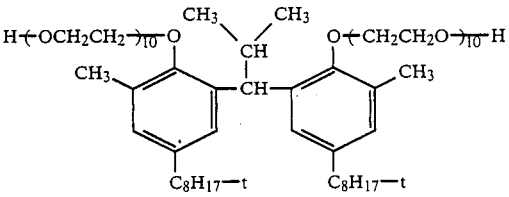
II-33
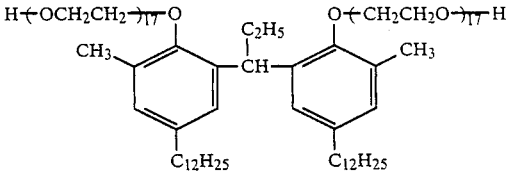
II-34
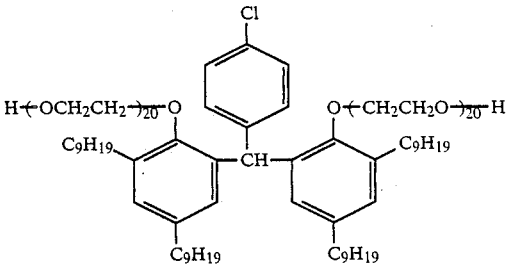
II-35
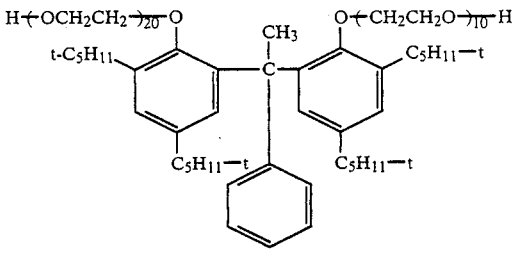
II-36
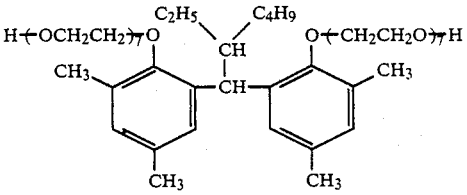
II-37
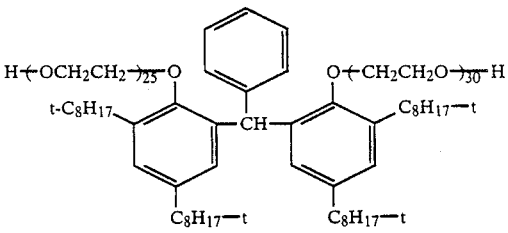

-continued
II-38
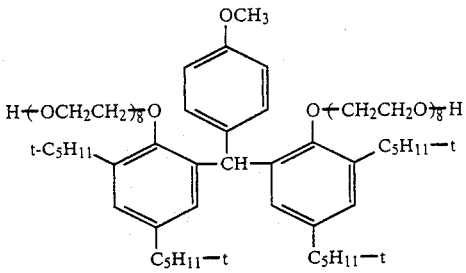
II-39
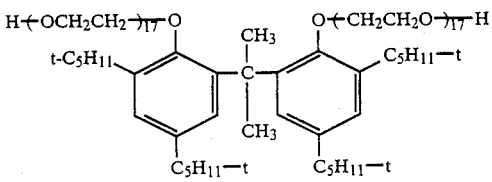
II-40
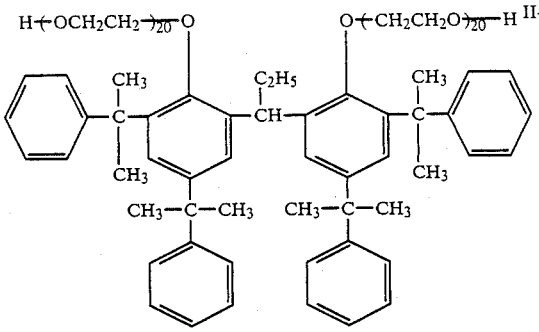
II-41
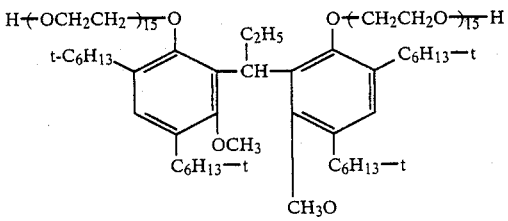
II-42
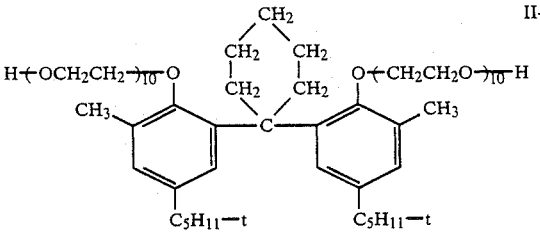
II-43
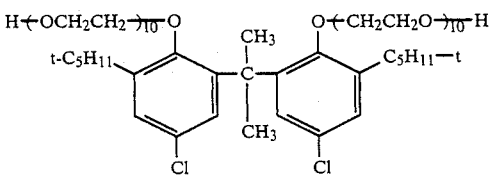
II-44
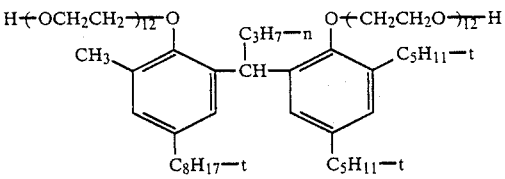
-continued
II-45
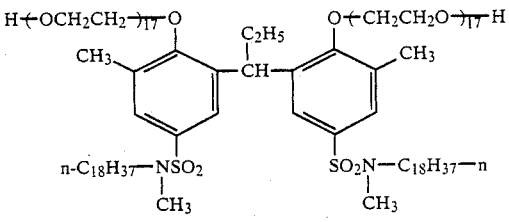
II-46
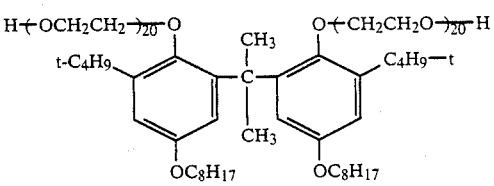
II-47
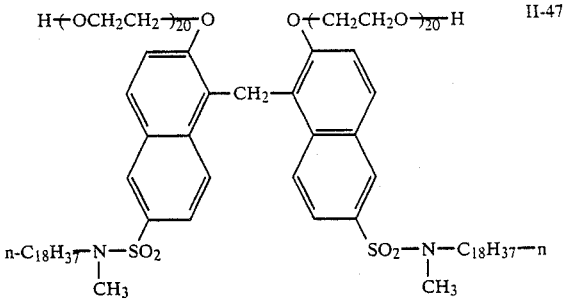
II-48
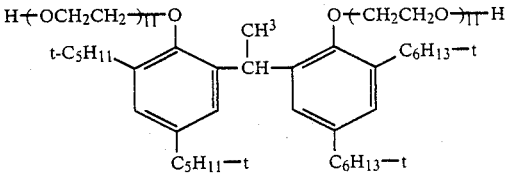
II-49
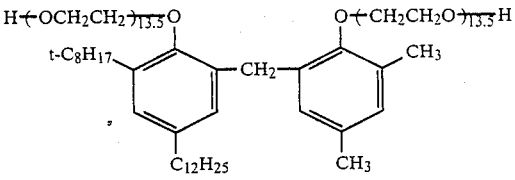
II-50
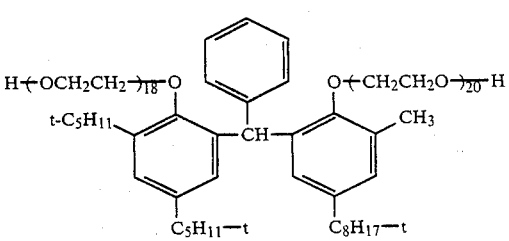
II-51
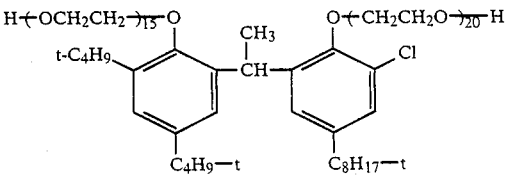
Besides the above-descried compounds, polyoxyethylenic surface active atent described in U.S. Pat. Nos. 2,982,651, 3,428,456, 3,457,076, 3,454,625, 3,552,972, and 3,655,387, Japanese Patent Publication No. 9610/76 (corresponding to U.S. Pat. No. 3,850,641)

Japanese Patent Application (OPI) Nos. 29725/78 (corresponding to British Pat. No. 1,548,799) and 89629/79 (the term "OPI" indicates an unexamined published Japanese patent application), U.S. Pat. No. 4,518,354, Japanese Patent Application (OPI) Nos. 208743/83 and 203435/83, and *New Surface Active Agent* by Hiroshi Horiguchi, published by Sankyo Shuppan K.K., 1975 may be used alone (when the surface active agent disclosed is represented by formula (I) or (II)), or in combination with the surface active agent of the present invention.

The amount of the polyoxyethylenic surface active agent of the formula (I) and/or (II) of the present invention depends on the type and form of photographic material used (depends on the desired level of antistatic property) and the coating method. In general, the amount of the polyoxyethylenic surface active agent is preferably from 0.05 to 500 mg (one side) per $m^2$, and more preferably from 0.5 to 100 mg (one side) per $m^2$ of the photographic material, and preferably from 0.01 to 500 mg per gram of silver.

For the application of the polyoxyethylenic surface active agent of the present invention can be accomplished by dissolving the polyoxyethylenic surface active agent in water or an organic solvent such as methanol, ethanol and acetone or a mixture of water and such an organic solvent, and then allowing an auxiliary layer such as backing layer, antihalation layer, intermediate layer, and protective layer and/or a silver halide emulsion layer to contain the resulting solution. It is preferable to add the surface active agent to an auxiliary layer, especially, to a surface protective layer.

When at least one compound selected from the group consisting of dextran and polymers containing repeating units of formula (III) shown below is incorporated to at least one of the silver halide emulsion layer(s) and/or the auxiliary layer(s) of the photographic material of the present invention, low temperature developability and short time developability can be improved.

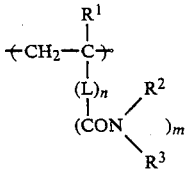

(III)

wherein $R^1$ represents a hydrogen atom or an alkyl group having from 1 to 6 carbon atoms; $R^2$ and $R^3$ each represents a hydrogen atom, or a substituted or unsubstituted alkyl, aryl, or aralkyl group having 10 carbon atoms or less; $R^2$ and $R^3$ may be the same as or different from each other, or may be bonded to each other to form a nitrogen-containing heterocyclic ring with the nitrogen atom in the formula; L represents a linking group haing a valence of (m+1); n represents an integer of 0 or 1; and m represents an integer of 1 or 2.

Preferred embodiments of polymers of the present invention having repeating units of the formula (III) will be described hereinafter.

In the formula (III), $R^1$ represents a hydrogen atom or an alkyl group having from 1 to 6 carbon atoms. Preferred examples of $R^1$ are hydrogen atom and methyl group.

$R^2$ and $R^3$ each represents a hydrogen atom, or a substituted or unsubstituted alkyl, aryl, or aralkyl group having 10 carbon atoms or less. $R^2$ and $R^3$ may be the same as or different from each other. Examples of suitable substituents for $R^2$ and $R^3$ include hydroxyl groups, lower alkoxy groups having from 1 to 10 carbon atoms, halogen atoms (i.e., F, Cl, Br, and I), amido groups

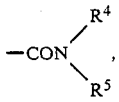

wherein $R^4$ and $R^5$ each represents a hydrogen atom or a substituted or unsubstituted alkyl group; example for substituents include a hydroxy group, a halogen atom, i.e., F, Cl, Br, and I, a cyano group), cyano group, $-SO_3M$ and —COOM (wherein M represents H and an alkali metal atom such as Na or K) $R^2$ and $R^3$ each is preferably a hydrogen atom, methyl group, ethyl group, or phenyl group, and more preferably a hydrogen atom. $R^2$ and $R^3$ may be bonded to form a hetrocyclic ring containing the nitrogen atom shown in the formula (III) or further containing one or more hetero atoms such as oxygen atom and nitrogen atom. The heterocyclic ring is preferably 5- or 6-membered ring.

L represents a linking group having a valence of (m+1). Examples of such a linking group include an alkylene group having from 1 to 10 carbon atoms and an arylene group having from 6 to 10 carbon atoms and groups having a valence of m+1 obtained by bonding two or more of them with ether linkage, ester linkage, or amido linkage.

n represents an integer of 0 or 1 and is preferably 0.

m represents an integer of 1 or 2 and is preferably 1, and when m is 2, n is 1.

Examples of suitable ethylenic unsaturated monomer constituting the repeating unit of formula (III) include the following compounds.

Compound 1 $CH_2{=}CH(CONH_2)$

Compound 2 $CH_2{=}CH(CONHCH_3)$

Compound 3 $CH_2{=}CH(CONHC_2H_5)$

Compound 4 $CH_2{=}CH(CONHCH_2OH)$

Compound 5 $CH_2{=}CH(CONHCH_2{-}C_6H_5)$

Compound 6 $CH_2{=}CH(CONH{-}C_6H_5)$

Compound 7 $CH_2{=}C(CH_3)(CONH_2)$

-continued

Compound 8

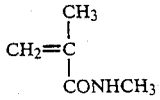

Compound 9

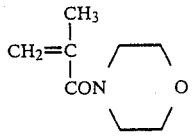

Compound 10

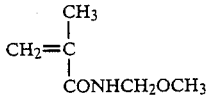

Compound 11

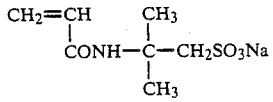

Compound 12

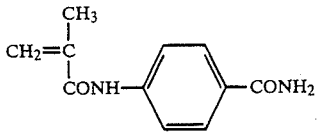

Compound 13

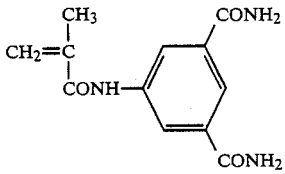

Compound 14

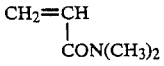

Compound 15

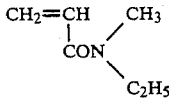

Compound 16

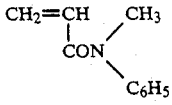

Compound 17

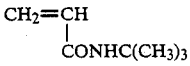

Compound 18

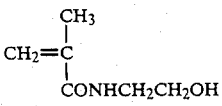

Compound 19

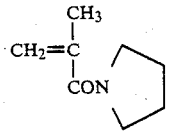

-continued

Compound 20

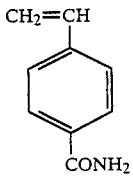

The repeating unit of formula (III) may contain two or more kinds of monomer units to provide a composite function as a polymer.

The preferable high molecular polymer of the present invention is a compound of formula (III)′ containing 70 mol% or more, more preferably 80 mol% or more, and most preferably 90 mol% or more of monomer of formula (III) as a polymer constituent unit.

Formula (III)′ is represented by

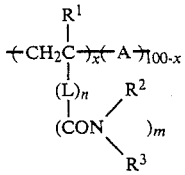

(III)′ wherein $R^1$, $R^2$, $R^3$, L, m, and n are the same as defined for formula (III); x represents a molar percentage, preferably of from 70 to 100; and A represents a monomer unit of copolymerizable ethylenic unsaturated monomers.

In the polymer of the formula (III)′ the monomer represented by A is incorporated in order to obtain a high layer strength, however, when x is less than 70 it is difficult to obtain a high covering power.

Examples of ethylenic unsaturated monomers constituting suitable polymers of the present invention include ethylene, propylene, 1-butene, isobutene, styrene, chloromethylstyrenes (preferably m- and p-, hydroxymethylstyrenes (preferably m- and p-), sodium vinylbenzenesulfonates (preferably p-), sodium vinylbenzylsulfonates (preferably p-), N,N,N-trimethyl-N-vinylbenzylammonium chloride, N,N-dimethyl-N-benzyl-N-vinylbenzylammonium chloride, α-methylstyrene, vinyltoluenes (preferably o- or p-), 4-vinylpyridine, 2-vinylpyridine, benzylvinylpyridinium chlorides (preferably m- or p-), N-vinylacetoamide, N-vinylpyrrolidone, 1-vinyl-2-methylimidazole, monoethylenic unsaturated esters of aliphatic acids such as vinyl acetate and allyl acetate, ethylenic unsaturated monocarboxylic acids or dicarboxylic acids or salts thereof such as acrylic acid, methacrylic acid, itaconic acid, maleic acid, sodium acrylate, potassium acrylate and sodium methacrylate, maleic anhydride, esters of ethylenic unsaturated monocrboxylic acids or dicarboxylic acids such as n-butylacrylate, n-hexylacrylate, hydroxyethylacrylate, cyanoethylacrylate, N,N-diethylaminoethylacrylate, methylmethacrylate, n-butylmethacrylate, benzylmethacrylate, hydroxyethylmethacrylate, chloroethylmethacrylate, methoxyethylmethacrylate, N,N-diethylaminomethacrylate, N,N,N-triethyl-N-methacryloyloxyethylammonium p-toluenesulfonate, N,N-diethyl-N-methyl-N-methacryloyloxyethylammonium p-toluenesulfonate, dimethyl itaconate and monobenzyl malate, and gelatin reactive monomers disclosed in Japanese Patent Application (OPI) Nos. 151937/81, 104927/82, and 142524/81. The polymer of the present invention may contain two or more kinds of monomer units as A to provide a composite function.

Examples of suitable compounds which may be used as the polymer of the present invention include the following compounds (wherein the subindex is represented in terms of molar percentage).

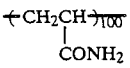
(III-1)

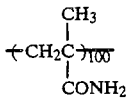
(III-2)

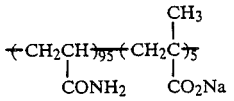
(III-3)

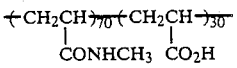
(III-4)

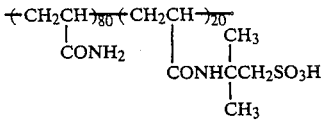
(III-5)

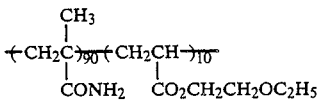
(III-6)

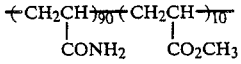
(III-7)

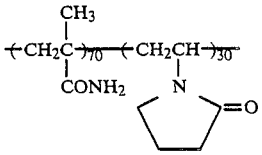
(III-8)

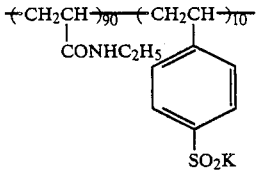
(III-9)

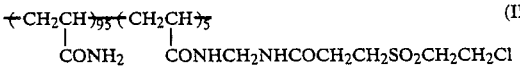
(III-10)

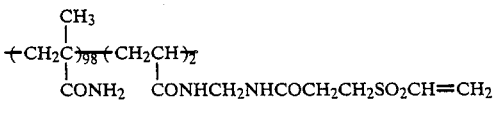
(III-11)

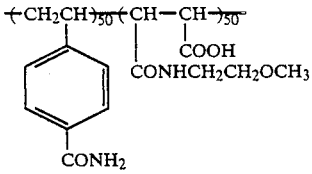
(III-12)

-continued

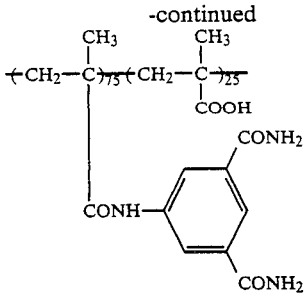
(III-13)

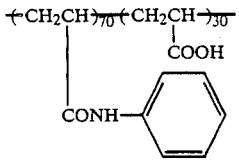
(III-14)

In the present invention, the polymer having repeating units of formula (III) which is added to the photographic emulsion layer and/or auxiliary layer preferably has a weight-average molecular weight of from 5,000 to 200,000, more preferably from 7,000 to 100,000, and most preferably from 9,000 to 70,000. The added amount of such a polymer is optionally selected. However, the optimum added amount of the polymer required to improve the covering power depends on the type of the photographic emulsion used.

The weight-average molecular weight of the dextran used in the present invention is preferably from 10,000 to 300,000, more preferably from 15,000 to 100,000, and most preferably from 20,000 to 70,000. Examples for such a dextran is a product obtained by reducing the molecular weight of a dextran-producing bacteria, such as leuconostoc mesenteroids, or a native dextran obtained by an action of dextran sucrose separated from a culture of such a bacteria on a sucrose solution. Reducing of the molecular weight is conducted by partial decomposition polymerization with an acid, alkali, or enzyme.

The polymer having repeating units of formula (III) and/or dextran of the present invention is incorporated to a silver halide photographic material in an amount preferably from 5 to 50% by weight, and more preferably from 15 to 30% by weight, based on the total weight of the binder in the layer to be incorporated with the polymer and/or dextran from viewpoint of adhesion with the photographic layers.

The polymer and/or the dextran (hereinafter referred to as polymer) of the present invention may be contained in any photographic emulsion layer and/or auxiliary layer (such as a surface protective layer) preferably in all layers. From viewpoint of adhesion of layers it is preferable that the polymer density (weight of polymer used in the present invention divided by weight of binder contained in the layer containing the polymer) of the photographic emulsion layer adjacent to the support is slightly smaller than (for example, the difference not more than 10%) or equal to that of other photographic emulsion layer. Anyway, when the polymer of the present invention is added to layers of the photographic material, it should be taken into account that the weight proportion of polymer to binder contained in the layer containing the polymer is not remarkably different between adjacent layers, although the degree of the difference depends on the molecular weight of the polymer.

In particular, in order to obtain excellent adhesion the polymer density of the photographic emulsion layer adjacent to the support is preferably not greater than that of other photographic emulsion layers, and is preferably 30% or less by weight based on the weight of the binder contained in the photographic emulsion layer adjacent to the support. When the polymer is added to the nonsensitive gelatin outermost layer, it should be taken into account that the polymer density of the outermost layer be not greater than that of any other layer. However, when a polyacrylamide having a low molecular weight (not more than 10,000) is added, the outermost layer or the lowermost layer may have the greatest polymer density. The polymer and dextran may be added to the emulsion in any step, but is preferably added to the emulsion after the second aging and before being applied on the support. The polymer and dextran may be added to the emulsion in the form of powder but is advantageously added to the emulsion in the form of a 5 to 20% aqueous solution.

In the present invention it is preferable to use the polymer having repeating units of formula (III) in combination with dextran. In order to obtain a high covering power and high adhesion the weight ratio of the polymer to dextran preferably is from 2/1 to 1/1.

The internally fogged silver halide emulsion of the present invention may comprise heterocyclic compounds having mercapto groups adsorbed on the surface of silver halide particles in the emulsion. This is advantageous in that it prevents or inhibit fogging upon development and eliminates uneven stain or helps maintain excellent photographic properties for a long period of time. As such a mercapto compound there may be preferably used a compound of formula (IV):

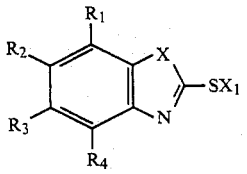

(IV)

wherein X represents —O—, —NH—, or —S—; and $R_1$, $R_2$, $R_3$, and $R_4$ each represents a hydrogen atom or a group capable of substituting for hydrogen atom, with the proviso that at least one of $R_1$, $R_2$, $R_3$, and $R_4$ is a substituted or unsubstituted alkyl group having from 1 to 13 carbon atoms or an aryl group having from 6 to 13 carbon atoms which is bonded to the benzene ring directly or via a divalent linking group. $X_1$ represents a hydrogen atom or a cation which is able to make the molecule represented by formula (IV) neutral.

In formula (IV) X is preferably —NH—.

$R_1$, $R_2$, $R_3$, and $R_4$ each is preferably a hydrogen atom, a halogen atom (e.g., F, Cl, or Br), a substituted or unsubstituted alkyl group (e.g., methyl group, trifluoromethyl group, ethyl group, n-octyl group, and benzyl group), a substituted or unsubstituted aryl group (e.g., phenyl group and p-chlorophenyl group), a substituted or unsubstituted alkoxy or aryloxy group (e.g., methoxy group, n-hexyloxy group, phenoxy group, n-octyloxy group, and 2-ethylhexyloxy group), a sulfonyl group (e.g., methansulfonyl group and p-toluensulfonyl group), a sulfonamido group (e.g., n-octansulfonamido group and p-toluensulfonamido group), a sulfamoyl group (e.g., diethylsulfamoyl group and 4-chlorophenylsulfamoyl group), a carbamoyl group (e.g., n-butylcarbamoyl group, 4-cyanophenylcarbamoyl group, and 2-ethylhexylcarbamoyl group), an amido group (e.g., n-hexanamido group, n-decanamido group, benzamido group, and 2-ethylhexanoyl amino group), an ureido group (e.g., 3-butylureido group and morpholinocarbonylamino group), an aryloxycarbonylamino group, and alkoxycarbonylamino group (e.g., ethoxycarbonylamino group, iso-butylcarbonylamino group, and phenoxycarbonylamino group), an aryloxycarbonyl group and alkoxycarbonyl group (e.g., ethoxycarbonyl group and phenoxy carbonyl group), an arylaminocarbonyloxy group and alkylaminocarbonyloxy group (e.g., phenylaminocarbonyloxy group and iso-butylaminocarbonyloxy group), cyano group, and an alkylthio group and arylthio group (e.g., n-octylthio group and methoxycarbonylphenylthio group). The number of carbon atom of these substitutents is preferably not more than 13, and more preferably not more than 11.

At least one of $R_1$, $R_2$, $R_3$, and $R_4$ is preferably a substituted or unsubstituted alkyl group having from 5 to 11 carbon atoms. Examples for the preferable divalent linking group include an amino linking group, a sulfonamido linking group, a ureido linking group, an ether linking group, a thioether linking group, a sulfonyl linking group, a carbonyl linking group, an urethane linking group, a carbamoyl linking group, and a sulfamoyl linking group.

Examples for the cation represented by $X_1$ include Na, K, and $NH_4$ cations.

Compounds represented by formula (IV) may be prepared by methods disclosed, for example, in J. Van Allan, B. D. Deacon, *Org. Synth.*, Vol. IV, p. 569 (1963), J. Bunner Ber., Vol. 9, p. 465 (1876), L. B. Sebrell, C. E. Boord, *J. Am. Chem. Soc.*, Vol. 45, p. 2390 (1923), and Japanese Patent Application No. 170588/84.

Examples of the compound of formula (IV) include those described in from pages 9 to 18 of Japanese Patent Application No. 170588/84 which can be effectively used.

Representative examples of the compound are shown below.

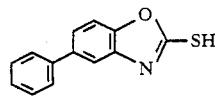

IV-1

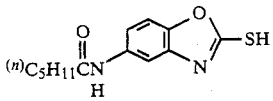

IV-2

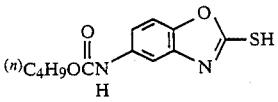

IV-3

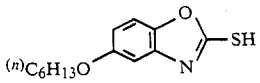

IV-4

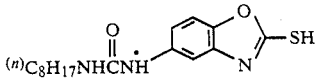

IV-5

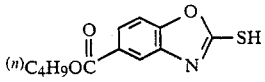

IV-6

-continued
IV-7
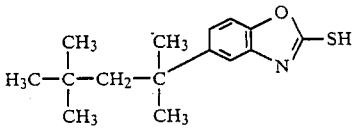
IV-8
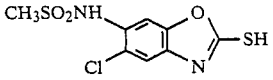
IV-9
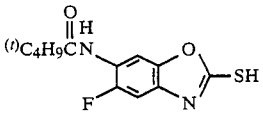
IV-10
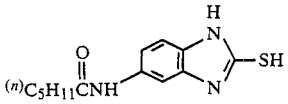
IV-11
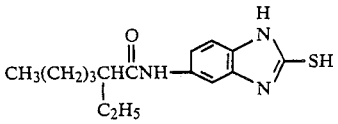
IV-12
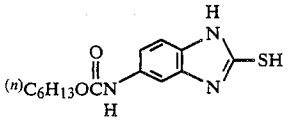
IV-13
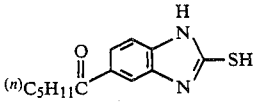
IV-14
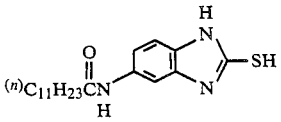
IV-15
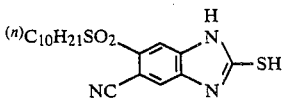
IV-16
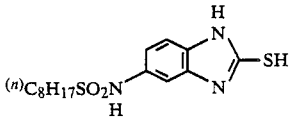
IV-17
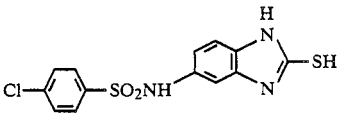
IV-18
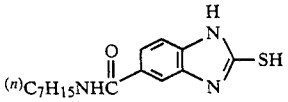
IV-19
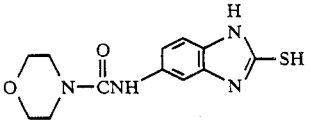
-continued
IV-20
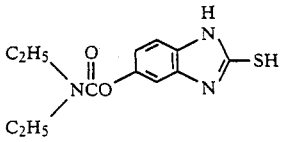
IV-21
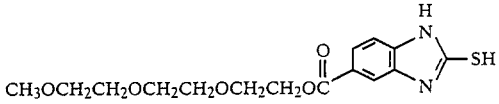
IV-22
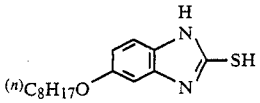
IV-23
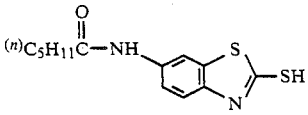
IV-24
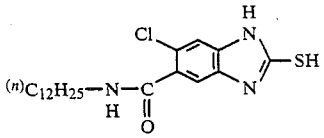
IV-25
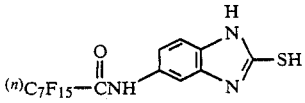
IV-26
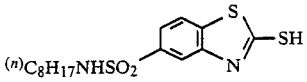
IV-27
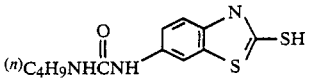
IV-28
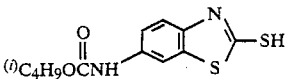
IV-29
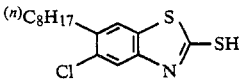
IV-30
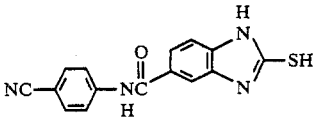
IV-31
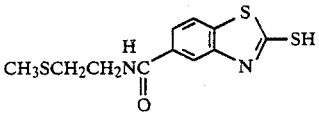
IV-32
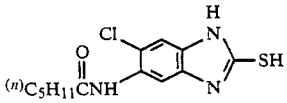
IV-33
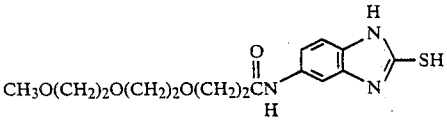

-continued

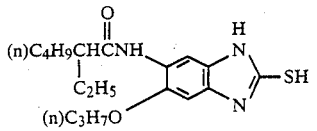

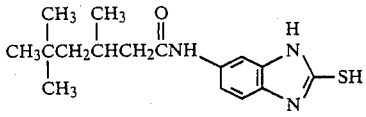

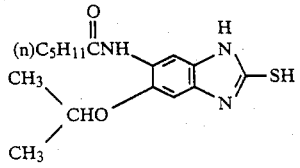

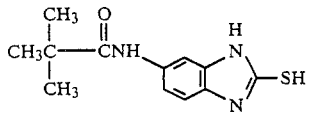

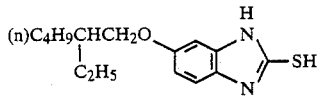

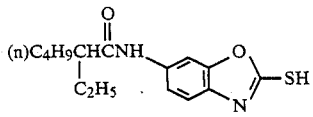

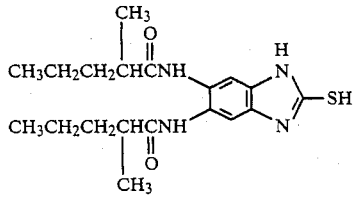

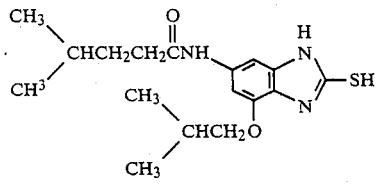

The compound of formula (IV) may be used in an amount of from $1\times10^{-5}$ to $1\times10^{-1}$ mole, and preferably $1\times10^{-4}$ to $1\times10^{-2}$ mole per mole of internally fogged particulate silver halide. The most preferable amount of the compound of formula (IV) is a value in the vicinity of the saturated amount of adsorption to the surface of the internally fogged particles. The addition of the compound of formula (IV) to the internally fogged silver halide emulsion can be accomplished by directly dispersing the compound in a hydrophilic colloid or dissolving the compound in an organic solvent such as methanol and ethylene glycol, and then adding the dispersion or solution to the hydrophilic colloid.

If an emulsion layer comprises an internally fogged silver halide emulsion and a photosensitive silver halide emulsion, it is preferable that the compound of formula (IV) is added to the internally fogged siler halide emulsion before the two emulsions are mixed with each other.

IV-34 The sensitivity of the photosensitive silver halide emulsion is higher than that of the internally fogged silver halide emulsion. More particularly, the sensitivity of the internally fogged silver halide emulsion is 1/10 times or less, preferably 1/100 times or less that of the photosensitive silver halide emulsion.

IV-35 The term "sensitivity" used in the foregoing description is as defined later.

As the photosensitive silver halide emulsion there may be used a normal silver halide emulsion such as surface latent image type emulsion.

IV-36 The surface latent image type silver halide emulsion used herein is an emulsion which shows a greater sensitivity, preferably two times or more sensitivity, when surface-developed than when internally developed after being exposed to light for 1 to 1/100 seconds. The "sensitivity" as used herein is defined as IV-37 $$S=100/Eh$$

wherein S is the sensitivity, and Eh represents the exposure required to obtain the intermediate density (Dmax+Dmin) between the maximum density (Dmax) and the miniumum density (Dmin).

IV-38 Process of surface development (A)

Development is carried out in a developing solution shown below, at a temperature of 20° C. for 10 minutes.

IV-39 N-methyl-p-aminophenol (hemisulfate): 2.5 g
Ascorbic acid: 10 g
Sodium metaborate tetrahydride: 35 g
Potassium bromide: 1 g Water is added to the above composition in an amount such that the volume of the solution reaches 1l.

IV-40 Process of internal development (B)

An emulsion is treated in a bleaching solution containing 3 g/l of red prussiate and 0.0126 g/l of phenosaphranine at a temperature of about 20° C. for 10 minutes. The emulsion thus treated is washed with water for 10 minutes, and then developed with a developing solution as described below at a temperature of 20° C. for 10 minutes.

IV-41 N-methyl-p-aminophenol(hemisulfate): 2.5 g
Ascorbid acid: 10 g
Sodium metaborate tetrahydride: 35 g
Potassium bromide: 1 g
Sodium thiosulfate: 3 g Water is added to the above composition in an amount such that the volume of the solution reaches 1l.

Examples of silver halide used in the surface latent image type silver halide emulsion include silver chloroiodide, silver iodobromide, and silver chloroiodobromide. Silver iodobromide is preferably used. The content of silver iodide is preferably within the range from 1 to 30 mole%, and more preferably within the range of from 3 to 10 mole%. The average particle size of the silver halide is preferably greater than that of the silver halide emulsion which has internally fogged nuclei (internally fogged silver halide emulsion), and more preferably 0.6 μm or more. The particle size distribution may be either small or large. The silver halide particles in the emulsion may be in the form of either regular crystals such as cubic or octahedral, or irregular crystals such as spherical or plate-like (tabular) or in the form of composite thereof. The particles may also comprise a mixture of particles in the form of various crystalline shapes. Preferably used in the present invention are plate-shaped particles having a diameter 5 times or more greater than its thickness. With respect to such plate-shaped particles there are detailed descriptions, for example, in U.S. Pat. Nos. 4,434,226 and 4,434,227 and Japanese Patent Application (OPI) No. 127,921/83.

The photographic emulsion of the present invention may be prepared by processes described in P. Glafkides, *Chimie et Physique Photographique,* published by Paul Montel (1976), G. F. Duffin, *Photographic Emulsion Chemistry,* published by The Focal Press (1966), and V. L. Zelikman et al, *Making and Coating Photographic Emulsion,* published by The Focal Press (1964). That is, the preparation of the photographic emulsion of the present invention may be accomplished by any of acidic process, neutral process, and ammonia process. The reaction of soluble silver salt and soluble halogen salt may be accomplished by any of single jet process, double jet process, and a combination thereof.

Alternatively, a process of forming particles in excess silver ions, that is, so-called reverse mixing process may be used.

As one form of the double jet process there may be used a process of maintaining pAg of the liquid phase in which silver halide is produced constant, that is, so-called controlled double jet process. This process can provide an emulsion of particulate silver halide having a regular crystalline shape and a nearly uniform particle size.

Two or more silver halide emulsions prepared separately may be mixed with each other to form the photographic emulsion of the present invention.

A cadmium salt, a zinc salt, a lead salt, a thallium salt, a iridium salt, or a complex salt thereof, a rhodium salt or a complex salt thereof, or an iron salt or a complex salt thereof may be allowed to exist in the process of formation of particulate silver halide or physical aging. These metal compounds are used in order to obtain effects such as sensitizing, stabilizing, or retarding reciprocity failure.

As the photosensitive silver halide emulsion there may be used an emulsion which has not been chemically sensitized, i.e., primitive emulsion. However, a chemically-sensitized emulsion is normally used. The chemical sensitization may be effected by the process described in the above-described P. Glafkides, *Chimie et Physique Photographique,* V. L. Zelikman et al, *Making and Coating Photographic Emulsion,* or in H. Freiser, *Die Grundlagen der Photographischen Prozesse mit Silberhalpgeniden,* published by Akademische Verlagsgesellschaft (1968).

Sulfur sensitization processes, using a compound or active gelatin containing sulfur, which is capable of reacting with silver ions, reduction sensitization process using a reducing material, or noble metal sensitization process using gold or other noble metal compound may be employed, singly or in combination. As such a sulfur sensitizer there may be used thiosulfate, thiourea, thiazoles, rhodanines, etc. Examples of these compounds include those described in U.S. Pat. Nos. 1,574,944, 2,410,689, 2,278,947, 2,728,668, 3,656,955, 4,032,928, and 4,067,740. As such a reduction sensitizer there may be used stannous salts, amines hydrozine derivatives, formamidinesulfinic acid, or silane compounds. Examples of these compounds include those described in U.S. Pat. Nos. 2,487,850, 2,419,974, 2,518,698, 2,983,609, 2,983,610, 2,694,637, 3,930,867, and 4,054,458. For noble metal sensitization a complex salt of the group VIII metal such as platinum, iridium, and palladium, as well as gold complex salts that may be used. Examples of such complex salts include those described in U.S. Pat. Nos. 2,399,083 and 2,448,060 and British Pat. No. 618,061.

The photographic material of the present invention may contain a hydrophilic colloid as a binder.

Examples of such a colloid which may be used for this purpose include gelatin, colloidal albumin, polysaccharide, cellulose derivatives, synthetic resins, polyvinyl compounds containing, for example, polyvinyl alcohol derivatives, acrylamide polymers, and other hydrophilic colloids commonly used in the art. A hydrophobic colloid, for example, a dispersion of polyvinyl compound, i.e., a compound capable of improving the dimensional stability of the photographic material may be contained therein together with the hydrophilic colloid. Examples of such a compound include water-insoluble polymers prepared by polymerization of vinyl monomers such as alkylacrylates or alkylmethacrylates, acrylic acid, and sulfoalkylacrylates or sulfoaklkylmethacrylates.

In order to prevent reduction of sensitivity or fogging during manufacture, storage, or treatment of the photographic material, the above photographic emulsion may contain various compounds. Examples of such compounds include a large number of compounds, such as 4-hydroxy-6-methyl-1, 3,3a,7-tetrazaindene, 3-methylbenzothiazole, 1-phenyl-5-mercaptotetrazole, heterocyclic compounds, mercury-containing compounds, mercapto compounds, metal salts, etc.

One example of such compounds which may be used is described in K. Mees, *The Theory of the Photographic Process,* 3rd Edition (1966) published by Macmillan, with reference to original literature. Any of fog inhibitors widely known in the art, such as those described in Japanese patent application (OPI) Nos. 81024/74, 6306/75, and 19429/75 and U.S. Pat. No. 3,850,639 may be used.

As the silver halide emulsion which has internal fogging nuclei (internally fogged silver halide emulsion) for used in the present photographic material there may be used an emulsion which gives a transmission fog density of 0.5 or less (the density of the support itself not included) when it is developed with D-19 (developer specified by Eastman Kodak) at a temperature of 35° C. for 2 minutes without being exposed to light after being applied on a transparent support in an amount of 2 $g/m^2$ in terms of silver and which gives a transmission fog density of 1.0 or more (the density of the support itself not included) when it is developed with a mixture of D-19 and 0.5 g/l of potassium iodide at a temperature of 35° C. for 2 minutes without being exposed to light after being applied on a transparent support in the same amount as above.

The preparation of the silver halide emulsion which has internal fogging nuclei may be accomplished by various known processes. Examples of these processes include a process described in U.S. Pat. No. 2,996,382 in which an emulsion having a high internal photosensitivity as described in U.S. Pat. No. 2,592,250 is fogged by irradiation with light rays, a process described in Japanese patent application (OPI) No. 215647/83 in which a core emulsion having fogged nuclei is prepared by making a fogging under the conditions of a low pAg and a high pH or making a chemical fogging with a reducing agent, gold compound or sulfur-containing compound, and a shell emulsion is then deposited around the core emulsion (see the preparation of core shell emulsion described in U.S. Pat. No. 3,206,313), and a process in which particulate silver halide is both externally and internally fogged, and the fogged nuclei on the surface thereof are then bleached with a red prussiate solution or the like.

The silver halide which has internally fogged nuclei should have a smaller average particle size than the silver halide of the surface latent image type silver halide emulsion, and preferably has an average particle size of from 1.0 to 0.05 μm, and more preferably from 0.6 to 0.1 μm.

The particle size of the silver halide of the present invention is represented by particle diameter when the particles are in the form of spheres or a sphere-like form, or by the particle diameter of a sphere having the same volume as the particles when they are in other forms, such as cubes and plates.

Examples of the internally fogged silver halide of the present invention include silver bromide, silver iodobromide, silver iodochlorobromide, silver chlorobromide, and silver chloride.

The weight proportion of the content of silver of the photosensitive silver halide to the content of silver of the internally fogged silver halide in the silver halide photographic material of the present invention may vary with the type of the emulsion (e.g., halogen composition) used, type and application of the photographic material used, and contrast of the emulsion used, but is preferably in the range of from 100/1 to 1/100, and more preferably in the range of from 10/1 to 1/10. The total coating amount of silver is preferably in the range of from 0.5 to 10 g/m$^2$.

Examples for preferable layer structure of the photographic material of the present invention are as following forms:

1. A structure in which an emulsion layer comprising a photosensitive silver halide and an internally fogged silver halide and a protective layer (auxiliary layer) are provided on a support in this order.

2. A structure in which an emulsion layer comprising a photosensitive silver halide is further provided between the emulsion layer and the protective layer (auxiliary layer) in the above structure.

3. A structure in which an emulsion layer comprising an internally fogged silver halide, an emulsion layer comprising a photosensitive silver halide, and a protective layer (auxiliary layer) are provided on a support in this order.

These structure may be formed on both sides of the support.

While the protective layer of the present invention is used as auxiliary layer in the above structures, further auxiliary layer or layers other than the protective layer may be provided. It is preferable that the compounds represented by formula (I) and/or (II) is incorporated in a surface protection layer in order to obtain antistatic effect.

The protective layer in the silver halide photographic material of the present invention is a layer comprising a hydrophilic colloid. As such a hydrophilic colloid there may be used the previously mentioned compounds. The protective layer may be either a single layer or multilayer.

The silver halide photographic material of the present invention may contain a matting agent and/or smoothing agent in the emulsion layer or the protective layer, preferably in the protective layer. Examples of suitable matting agents include organic compounds such as water-dispersible vinyl polymer as polymethylmethacylate or inorganic compounds such as silver halide and strontium barium sulfate having a suitable particle diameter (preferable particle diameter is in the range of from 0.3 to 5 μm or twice or more, and more preferably 4 times or more, the thickness of the protective layer). The smoothing agent is useful for the prevention of failure in adhesion as performed by the matting agent. In particular, the smoothing agent is useful for improvements in the frictional properties affecting the adaptability of movie film to camera upon photographing or projecting. Examples of the smoothing agent of the present invention include wax such as liquid paraffin and higher fatty acid esters, polyfluorinated hydrocarbons or derivatives thereof, and silicone such as polyalkyl polysiloxane, polyaryl polysiloxane, polyalkylaryl polysiloxane, or alkylene oxide-added derivatives thereof.

The silver halide photographic material of the present invention may optionally comprise an antihalation layer, an intermediate layer, a filter layer, or the like.

The photographic silver halide emulsion layer and ohter hydrophilic colloidal layers of the photographic material of the present invention may be hardened with any hardening agent. Examples of such suitable hardening agents include vinyl sulfonyl compounds, hardening agents having active halogens, dioxane derivatives, and oxypolysacharides, such as oxy starch, as described in Japanese patent application (OPI) Nos. 76025/78, 76026/78 and 77619/78.

The photographic silver halide emulsion layer of the present invention may contain other additives useful for the photographic emulsion. Such additives include, for example, a lubricant, a sensitizer, a photoabsorbing dye, and a plasticizer.

In the present invention, the silver halide emulsion may contain a compound which rleases iodide ions (e.g., potassium iodide). Alternatively, a developer containing iodide ions may be used to obtain desired images.

In the photographic material of the present invention, the hydrophilic colloidal layer may contain a water-soluble dye as a filter dye or for the purpose of prevention of irradiation or halation or other purposes. Examples of such a water-soluble dye include oxonol dyes, hemioxonol dyes, styryl dyes, merocyanine dyes, cyanine dyes and azo cyanines. Preferable among these dyes are oxonol dyes, hemioxonol dyes, and merocyanine dyes.

In the photosensitive material of the present invention, if the hydrophilic colloidal layer contains a dye or a ultraviolet absorber, these compounds may be mordanted with a cationic polymer or the like.

The photographic material of the present invention may contain a surface active agent for various purposes. Such a surface active agent may be any of nonionic, ionic and amphoteric surface active agents depending on the purpose. Examples of these surface active agents include polyoxy alkylene derivatives and amphoteric amino acids (including sulfobetaines) as described in U.S. Pat. Nos. 2,600,831, 2,271,622, 2,271,623, 2,275,727, 2,787,604, 2,816,920, and 2,739,891, and Belgian Pat. No. 652,862.

In the photographic material of the present invention, the photographic emulsion may be spectrally sensitized with a sensitizing dye to a blue light of relatively long wavelength range, green light, red light and infrared light. Examples of sensitizing dyes which may be used include cyanine dyes, merocyanine dyes, complex cyanine dyes, complex merocyanine dyes, holopolar cyanine dyes, styryl dyes, hemicyanine dyes, oxonol dyes, and hemioxonol dyes.

The sensitizing dye of the present invention may be used in the same concentration as used in normal negative type silver halide emulsion. In particular, the sensitizing dye is preferably used in a concentration such that it does not substantially deteriorate the inherent sensitivity of the silver halide emulsion. Accordingly, the sensitizing dye is preferably used in a concentration of from about $1.0\times10^{-5}$ to about $5\times10^{-4}$ mol, and more preferably from about $4\times10^{-5}$ to about $2\times10^{-4}$ mol per mole of silver halide.

In the photographic material of the present invention, the photographic emulsion layer and other layers are applied on one or both sides of a flexible support of a type which is commonly used for photographic material. Examples of useful flexible supports include film made of synthetic high polymer such as cellulose acetate, cellulose acetate butyrate, pollystyrene and polyethylene terephthalate, baryta layer, and paper on which an α-olefin polymer such as polyethylene, polypropylene, and ethylene-butene copolymer is applied or laminated.

In the preparation of the present photographic material, the photographic emulsion layer and other hydrophilic colloidal layers may be applied on a support or other layers by various known coating processes. These coating processes include a dip coating process, roller coating process, curtain coating process, and extrusion coating process.

The present invention can be applied to any field where a photographic material having a high sensitivity or contrast is required. For example, the present photographic material can be used as X-ray photographic material, lithographic photographic material, negative type black-and-white photographic material, negative type color photographic material, or color papr photographic material.

Alternatively, the photographic material can be used as diffusion transfer photographic material or color diffusion transfer photographic material on which positive images are formed by the process in which undeveloped silver halide is dissolved and then precipitated on the image receiving layer adjacent to the silver halide emulsion layer.

The photographic processing of the present photographic material may be accomplished by any of known processes and treating liquids, e.g., as described in *Research Disclosure* (No. 176, pages 28–30) (RD-17643), December, 1978. The photographic processing may be either black-and-white photographic processing in which silver images are formed, or color photographic processing in which color images are formed depending on the purpose. The processing temperature is normally selected from the range of from 18° to 50° C., but may be lower than 18° C. or higher than 50° C.

The developer used for black-and-white photographic processing may contain a known developing agent. As such a developing agent there may be used a dihydroxybenzene such as hydroquinone, a 3-pyrazolidone such as 1-phenyl-3-pyrazolidone, or an aminophenol such as N-methyl-p-aminophenol, singly or in combination. The photographic processing of the present photographic material may also be accomplished with a developer containing imidazole as a solvent of silver halide as described in Japanese patent application (OPI) No. 78535/82. Alternatively, a developer containing a solvent of silver halide and additives such as an indazole and a triazole as described in Japanese patent application (OPI) No. 37643/83 may be used. The developer used in the present invention may also contain a known preservative, alkali agent, pH buffer, and antifoggant. Furthermore, the developer may optionally contain a dissolution assistant, toning agent, development accelerator, surface active agent, anti-foaming agent, water softener, hardening agent, and viscosity donor.

A so-called "lithographic" developing process can be applied for the photographic emulsion of the present invention. The lithographic developing process is a developing process which is carried out infectiously under the condition of a low sulfite ion concentration with a dihydroxy benzene as a developing agent for the purpose of photographic reproduction of line images or network photographic reproduction of half tone images. For details see Mason *Photographic Processing Chemistry,* (1966) pages 163–165.

One of specific forms of developing processes is a process in which a photographic material which has previously been allowed to contain a developing agent in, for example, the emulsion layer, is treated with an alkaline aqueous solution so that it is developed. Hydrophobic developing agents may be allowed to exist in the emulsion layer by various processes, as described in *Research Disclosure,* (RD-16928) May, 1968, U.S. Pat. No. 2,739,890, British Pat. No. 813,253, and West German Pat. No. 1,547,763. Such a developing process may be carried out in combination with a silver salt stabilization treatment with a thiocyanate.

As a fixing liquid a composition may be used which is commonly used in the art. Example of suitable fixing agents include thiosulfate, thiocyanate, and other organic sulfur compounds which are known as effective fixing agents. These fixing agents may optionally contain a water-soluble aluminum salt as a hardning agent.

The present invention is further illustrated by the following examples:

EXAMPLE 1

(1) Preparation of surface-photosensitive silver halide emulsion

An aqueous solution of silver nitrate and an aqueous solution of potassium bromide and potassium iodide were simultaneously added to an aquaous solution of potassium bromide, potassium iodide and gelatin in a container by an ammonia process to prepare a silver iodobromide (AgI=4 mole%) having elliptical and thick plate-like particles with an average diameter of 1.0 μm. The emulsion thus prepared was washed in the normal precipitation process, and then chemically sensitized by a gold-sulfur sensitization process using chlorauric acid and sodium thiosulfate. 4-hydroxy-6-methyl-1,3,3a,7-tetrazaindene was added to the emulsion thus sensitized as a stabilizer to obtain a photographic silver iodobromide emulsion A.

(2) Preparation of internally fogged particulate emulsion

An aqueous solution of silver nitrate and a mixed aqueous solution of potassium bromide and sodium chloride were simultaneously added to a 2-wt% gelatin aqueous solution while the latter was being stirred at a temperature of 55° C. to prepare core particles. The mixture thus prepared was heated to a temperature of 75° C. Proper amounts of sodium hydroxide and silver nitrate were then added to the mixture which was then aged for 15 minutes to form fogged nuclei on the core particles. The mixture was allowed to cool to a temperature of 55° C. Proper amounts of acetic acid and potassium bromide were added to the mixture so that the pH and pAg values were returned to the initial values. An aqueous solution of silver nitrate and a mixed aqueous solution of potassium bromide and sodium chloride were simultaneously added to the mixture. The product was then desalted in a conventional condensation process, and then re-dispersed into an aqueous gelatin solution. The dispersion was then allowed to absorb a mercapto compound shown below to prepare an emulsion B-1 of silver chlorobromide having an average particle size of 0.3 μm.

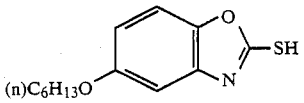

(3) Preparation of emulsion coating composition 5 parts by weight (as silver content) of emulsion A and 1 part (as silver content) by weight of emulsion B-1 were mixed with each other. 4-hydroxy-6-methyl-1,3,3a,7-tetrazaindene as a stabilizer, a dodecylbenzenesulfonic acid salt as a coating assistant, and a poly-potassium p-vinyl benzenesulfonate compound and a mesoionic triazolium compound as thickening agents were added to the mixture to prepare a coating composition. The silver-to-gelatin proportion of the coating solution was 1.0.

(4) Preparation of coating composition for surface protective layer

A 10-wt% gelatin aqueous solutions were prepared containing gelatin, sodium polystyrenesulfonate as a thickening agent, particulate polymethylmethacrylate (average particle size: 3.0 μm) as a matting agent, N,N'-ethylenebis-(vinylsulfonylacetoamide) as a hardening agent, sodium t-octylphenoxyethoxyethanesulfonate as a coating assistant, one of the polyoxyethylenic surface active agents shown in Table 1 and a substantially non-photosensitive particulate silver chlorobromide emulsion. In the comparison examples the following polyoxyethylenic surface active agents were used:

V-1 Oleic ester polyethylene oxide (molecular weight: 1030)

$$CH_3(CH_2)_7CH{=}CH(CH_2)_7COO(CH_2CH_2{-}O)_{17}H$$

V-2 Nonylphenolether polyethyleneoxide (molecular weight: 1144)

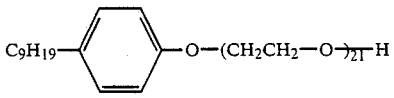

V-3 Oleylether polyethyleneoxide (molecular weight: 1500)

$$CH_3(CH_2)_7CH{=}CH(CH_2)_7CH_2{-}O{-}(CH_2CH_2O)_{28}H$$

V-4 Nonylphenolether polyethyleneoxide; (molecular weight: 2420)

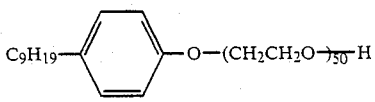

(5) Preparation of coated specimens

The emulsion coating composition prepared in the process (3) was applied on both sides of a polyethyleneterephthalate support so that the applied amount reached 2.5 g/m$^2$ in terms of amount of silver. The coating composition prepared in the process (4) was applied on both sides of the support so that the applied applied on both sides of the support so that the applied amount on each side of the support reached 1.2 g/m$^2$ in terms of amount of gelatin.

(6) Sensitometry

After being stored at a temperature of 25° C. and a humidity of 65 %RH (relative humidity) for 7 days, these specimens were exposed to a blue light having a wavelength range of 360 to 480 nm, with its peak intensity centered at 414 nm, throuh a continuous wedges. The specimens thus light-exposed were then developed and fixed with the following treating solution at a temperature of 35° C. for 25 seconds. The specimens thus treated were then fixed with the following fixing solution, washed with water and dried.

Developer

Potassium hydroxide: 29.14 g
Glacial acetic acid: 10.96 g
Potassium sulfite: 44.20 g
Sodium bicarbonate: 7.50 g
Boric acid: 1.00 g
Diethylene glycol: 28.96 g
Ethylene diamine tetraacetic acid: 1.67 g
5-methylbenzotiazole: 0.06 g
5-nitroimidazole: 0.25 g
Hydroquinone: 30.00 g
1-phenyl-3-pyrazolidone: 1.50 g
Glutaraldehyde: 4.93 g
Soldium metabisulfite: 12.60 g
Potassium bromide: 7.00 g Water was added to the above composition in an amount such that the volume thereof reached 1 l. (The pH of the solution was adjusted to 10.25.)

Fixing solution(35° C.)

Ammonium thiosulfate: 200 g
Sodium sulfite anhydride: 20 g
Boric acidl: 8 g
Disodium ethylenediamine tetraacetate: 0.1 g
Aluminium borate: 15 g
Sulfonic acid: 2 g
Glacial acetic acid: 22.0 g Water was added to the above composition in an amount such that the volume thereof reached 1. (The pH of the solution was adjusted to 4.2.)

The specimens of photographic material thus treated were measured for sensitometry. The results are shown in Table 1.

In Table 1, the value of sensitivity was determined as reciprocal of the exposure required to obtain a transmission light density of (fog+0.3) in terms of the value relative to that of specimen No. 1 as 100. The gamma value was determined as the slope between density value of (fog+0.25) and (fog+2.0) on the characteristic curve. In addition to the sensitivity values and the gamma values, the maximum transmission density Dmax was determined. The maximum transmission density Dmax was divided by the amount of development silver ($g/m^2$) to obtain a coverage of developed silver (hereinafter referred to as "CP"), which is also shown in Table 1.

(7) Evaluation of roller mark

The pressure resistance of the photographic material upon development (resistance to pressure marks, i.e., roller marks formed by rollers of an automatic developing apparatus) was evaluated as follows:

The specimen was exposed to light by a sensitometer. The specimen thus light-exposed was subjected to development at a temperature of 35° C. for 25 seconds. The development was conducted by means of an automatic X-ray developing apparatus equipped with special 90-second opposition rollers having roguth surface. The previously described developer was used. The degree of the roler marks thus formed on the specimen were classified into five stages for evaluation.

5: None

4: Extremely slight

3: Slight (acceptable for practical use)

2: Many roller marks (unacceptable for practical use)

1: Extremely many roller marks (8) Evaluation of antistatic properties

The antistatic properties (hereinafter referred to as "AS") were evaluated as follows:

The antistatic properties were determined by the measurement of the surface resistivity (hereinafter referred to as "SR") and the static marks formed.

Measurement of SR

The specimen was clamped between two brass electrodes having a length of 10 cm and a gap of 0.14 cm. (The contact surface of the electrodes was made of stainless steel.) The measurement was conducted by means of an insulation tester (TAKEDA RIKEN Model TR 8651). The value reached 1 minute after application was used.

Formation of static marks

The unexposed photographic material was laminated on a rubber sheet in such a manner that the surface of the photographic material containing an antistatic agent was opposed thereto. The lamination was then pressed from its upper side (the side of the photographic material) by a rubber roller. The specimen was peeled off from the rubber sheet so that static marks were formed thereon.

The measurement of the surface resistivity was conducted at a temperature of 25° C. and humidity of 25%RH. The formation of static marks was conducted under the same conditions. The adjustment of the humidity of the specimen was conducted by storing them under these conditions overnight. For evaluation of the static marks thus formed, the specimen was developed at a temperature of 35° C. for 25 seconds with the developer aforementioned. The degree of the static marks were classified into the following five stages:

A: No static marks observed.

B: A small number of static marks observed.

C: A relatively large number of static marks observed.

D: A very large number static marks observed.

E: Static marks observed on the entire surface of the specimen.

TABLE 1

| Specimen No. | Polyethylene oxide compound No. | Polyethylene oxide compound Amount per one side ($mg/m^2$) | Relative sensitivity | Gamma | Covering power | Anti-roller mark properties | Anti-static properties SR (Ω) | Static marks | Remarks |
|---|---|---|---|---|---|---|---|---|---|
| 1 | — | — | 100 | 2.10 | 0.60 | 5 | $1.5 \times 10^{14}$ | E | Comparison example |
| 2 | V-1 | 35 | 120 | 3.35 | 0.75 | 2 | $1.2 \times 10^{12}$ | B | " |
| 3 | V-2 | " | 125 | 3.50 | 0.80 | 2 | $4.6 \times 10^{12}$ | C | " |
| 4 | V-3 | " | 130 | 3.55 | 0.81 | 1 | $6.5 \times 10^{12}$ | " | " |
| 5 | V-4 | " | 130 | 3.55 | 0.82 | 1 | $9.8 \times 10^{12}$ | D | " |
| 6 | I-3 | " | 122 | 3.50 | 0.78 | 3 | $3.3 \times 10^{11}$ | A | Present invention |
| 7 | II-8 | " | 120 | 3.40 | 0.75 | 4 | $3.1 \times 10^{11}$ | " | " |
| 8 | II-10 | " | 122 | 3.48 | 0.77 | 4 | $2.2 \times 10^{11}$ | " | " |
| 9 | II-19 | " | 120 | 3.49 | 0.78 | 4 | $2.5 \times 10^{11}$ | " | " |

As can be seen in Table 1, any specimen showed a remarkable increase in the covering power and relative sensitivity caused by the addition of the polyethylene oxide compound. However, the specimens containing the polyethylene oxide compound of the present invention surprisingly showed acceptable anti-roller mark properties while those contaiing the polyethylene oxide compound of the comparison examples showed remarkably poor anti-roller marks properties which are unacceptable. The polyethylene oxide compound of the present invention is also excellent in improvement in antistatic properties as compared to those of comparison examples.

EXAMPLE 2

Specimens were prepared in the same manner as in Example 1 except that the emulsion of internally fogged particles was replaced by the following emulsion:

The preparation of the emulsion of internally fogged particles was conducted as follows.

Particles were formed in such a manner that the sensitivity thereof reached 1/100 or less of that of the emulsion of Example 1, by the process described in U.S. Pat. No. 2,592,250. The particles were then internally fogged by light. The particles thus fogged were allowed to adsorb the mercapto compound B-1 of Example 1 to obtain an internally fogged silver chlorobromide emulsion (AgCl: 9 mol%) having an average particle diamenr of 0.33 μm.

The emulsion thus prepared was used for the measurement of the varioius evaluation tests. The results showed that the specimens made of the emulsion containing the polyethylene oxide compound of the present invention is remarkably excellent in anti-roller mark properaties and AS properties as compared to the specimens containing the polyethylene oxide compound of the comparison examples.

EXAMPLE 3

(1) Preparation of emulsion coating composition 4 parts by weight (as silver content) of the emulsion A prepared in Example 1 and 2 parts by weight (as silver content) of the emulsion B-1 prepared in Example 1 were mixed with each other. 4-hydroxy-6-methyl-1,3,3a,7-tetrazaindene as a stabilizer, a dodecylbenzenesulfonate as a coating assistance, sodium polystyrenesulfonate as a thickening agent, a mesoionic triazorium compound and a sensitizing dye having a peak absorption in the range of blue light are added to the mixture to prepare a coating composition. 20% of the gelatin contained in the coating composition were replaced by a mixture of polyacrylamide and dextran. The silver-to-gelatin weight proportion of the coating composition thus prepared was 1.25.

(2) Preparation of coating composition for surface protective layer

A coating composition was prepared in the same manner as in Example 1, except that the type of the polyoxyethylenic surface active agent was different from that of Example 1 and 20% of the gelatin contained in the composition was replaced by a mixture of polyacrylamide and dextran. The gelatin concentration of the coating solution thus prepared was 8%.

(3) Preparation of coated specimens and evaluation of sensitometry, roller mark, and antistatic properties These tests were conducted in the same manner as in Example 1. The results are shown in Table 2.

TABLE 2

| Specimen No. | Polyethylene oxide compound No. | Amount per one side ($mg/m^2$) | Relative sensitivity | Gamma | Covering power | Anti-roller mark properties | Anti-static properties SR (Ω) | Static marks | Remarks |
|---|---|---|---|---|---|---|---|---|---|
| 1 | — | — | 100 | 2.25 | 0.65 | 5 | $1.5 \times 10^{14}$ | E | Comparison example |
| 2 | V-1 | 35 | 120 | 3.50 | 0.80 | 2 | $1.2 \times 10^{12}$ | B | " |
| 3 | V-2 | " | 124 | 3.72 | 0.83 | 2 | $4.7 \times 10^{12}$ | C | " |
| 4 | V-3 | " | 131 | 3.75 | 0.85 | 1 | $6.4 \times 10^{12}$ | " | " |
| 5 | V-4 | " | 129 | 3.77 | 0.85 | 1 | $9.6 \times 10^{12}$ | D | " |
| 6 | I-2 | " | 123 | 3.60 | 0.83 | 3 | $3.5 \times 10^{11}$ | A | Present Invention |
| 7 | II-8 | " | 122 | 3.55 | 0.80 | 4 | $3.4 \times 10^{11}$ | " | " |
| 8 | II-11 | " | 124 | 3.60 | 0.82 | 4 | $2.1 \times 10^{11}$ | " | " |
| 9 | II-27 | " | 120 | 3.62 | 0.83 | 4 | $2.2 \times 10^{11}$ | " | " |

As can be seen in Table 2, any specimen showed a remarkable increase in the covering power and relative sensitivity caused by the addition of the polyethylene oxide compound. However, the specimens containing the present polyethylene oxide compounds showed acceptable anti-roller mark properties, while those containing the polyethylene oxide compounds of the comparison exmaples showed remarkably poor anti-roller mark properties which are unacceptable. The prsent polyethylene oxide compounds are also excellent in improvement in AS properties as compared to the comparison examples.

EXAMPLE 4

Specimens were prepared in the same manner as in Example 3 except that the monomethine dye having a peak absorption in blue range was replaced by a sensitizing dye having a peak absorption in green range in the preparation of the emulsion coating composition and the sensitometry was conducted by a green light having a high peak intensity at 550 nm. These specimens showed the same results as in Example 3.

As is apparent from the foregoing description, the present invention provides a silver halide photographic material which enables improvements in pressure resistance and antistatic properties and gives a remarkably high coverage of developed silver (covering power).

EXAMPLE 5

(1) Preparation of surface-photosensitive silver halide emulsion

An emulsion was prepared in the same manner as (1) in Example 1.

(2) Preparation of internaly fogged particulate emulsion

An emulsion was prepared in the same manner as (2) in Example 1.

(3) Preparation of emulsion coating composition

An emulsion eas prepared in the same manner as (3) in Example 1.

Polyacrylamide of compound III-1 ($\overline{MW}=60,000$) and/or dextran ($\overline{MW}=68,000$) in the form of an aqueous solution was added to the coating composition thus prepared in amounts shown in Table 3.

(4) Preparation of coating composition for surface protective layer

A coating composition was prepared comprising gelatin, sodium polyethylenesulfonate as a thickening agent, particulate polymethyl methacrylate (average particle size: 3.0 μm) as a matting agent, N,N'-ethylene-bis-(vinylsulfonylacetamide) as a harderner, sodium t-octylphenoxyethoxyethanesulfonate as coating assistans and polyoxyethylenic surface active agent II-10, and a substantially nonsensitive silver chlorobromide particle emulsion. Polyacrylamide of compound III-1 ($\overline{MW}=68,000$) in the form of a aqueous solution were added to the coating composition thus prepared in amounts shown in Table 3.

(5) Preparation of caoted specimens

The emulsion coating composition prepared in the process (3) was applied on both sides of a polyethyleneterphthalate suport in such a manner trhat the applied amount on each side reached 2.5 $g/m^2$ amd 1/63 $g/m^2$ in terms of amounts of silver and gelatin, respectively. The coating composition for surface protective layer prepared in process (4) was further applied on both sides on the support in such a manner that the applied amount on each side reached 1.16 $g/m^2$ in terms of amount of gelatin. Thus, the total amount of gelatin applied on each side was 2.79 $g/m^2$.

(6) Sensitometry

After being stored at a temperature of 25° C. and a humidity of 65%RH for 7 days, these specimens were exposed to a blue light having a wavelength range of 360 to 480 nm with its peak intensity centered at 414 nm through a continuous wedges. The specimens thus light-exposed were then developed with the developer shown hereinbefore at a temperature of 31° C. for 25 seconss. Although the standard development temperature of 35° C., the above temeprature was used ot observe the developability at a low temperature. The specimens thus treated were then fixed with the fixing solution shown hereinbefore, washed with water and dried.

The specimens of photographic material thus treated were measured for sensitometry. The results are shown in Table 3.

In Table 3, the value of sensitivity was detremined in the same manner as in Example 1.

The development factor in Table 3 was detremined as follows:

The photographic material was subjected to exposure sufficient to provide Dmax, developed with the above developer at a temperature of 31° C., fixed with the above fixing agent, washed with water, and then dried. The development factor was calculated by dividing the amount of developed silver on the specimen by the applied amount of silver and then multiplying the quotient by 100. The sensitivity change ΔS between 37° C.-development and 31° C.-development in Table 3 ($S_{2.0}$ (37° C.)-$S_{2.0}$ (31° C.)) was determined as follows:

The specimens which had been developed at temperatures of 37° C. and 31° C., respectively, for 25 seconds were measured for sensitometry. The sensitivity change ΔS was detremined as the difference of the common logarithms of the reciprocal of the exposure required to provide a transmission light density of (fogg+2.0) on the respective characteristic curves. Teh haze was evaluated and represented as follows:

The specimens were directly developed and fixed at a temperature of 35° C., washed with water, and allowed to dry. These specimens were then measured for the percentage of scattered light to the gross transmitted light. The evaluation was made by clasisfying the vlaues thus obtained into the following five categories.

Less then 10%: 5
10% to less than 14%: 4
14$ to less than 18%: 3
18% to less than 22%: 2
22% or more: 1

Finally, the adhesion test upon wetting (peel test) and its evaluation were conducted as follows:

In the steps of development, fixing, and water washing, the photogrpahic emulsion side of the film was scratched with an iron stylus in such a amnner that two intersencting lines were marked thereon. These scratches were then rubbed with a finger tip. The evaluation was made as follows.

A means no peeling of emulsion layer is observed except for the scratches.

B means the maximum peel wideth (regardless of the position of peeled layer, i.e., whether it is between the surface protective layer and the emulsion layer, or between the mulsion layer; and support layer) is within 5 mm.

C means the maximum peel width is more than 5 mm.

As can be seen in Table 3, the addition of polyacrylamide or polyacrylamide and dextran can improve the relative sensitivity, development factor, and development temperature dependency of sensitivity with little or no deterioration of the haze and wet adhesivity.

TABLE 3

| Specimen No. | Amount of polyacryl amide (Compound III-1 MW = 60,000) in emulsion layer ($g/m^2$) | Amount of dextran (MW = 68,000) in emulsion layer ($g/m^2$) | Amount of polyacryl amide (Compound III-1) MW = 60,000) in protective layer ($g/m^2$) | Amount dextran (MW = 68,000) in protective layer ($g/m^2$) | Rel. $S_{1.0}$ (31° C.) (represented as common logarithms) |
|---|---|---|---|---|---|
| 1 | — | — | — | — | 1.00 |
| 2 | 0.326 | — | — | — | 1.05 |
| 3 | 0.217 | 0.109 | — | — | 1.07 |
| 4 | — | — | 0.326 | — | 1.02 |
| 5 | — | — | 0.217 | 0.109 | 1.05 |
| 6 | 0.326 | — | 0.202 | — | 1.10 |
| 7 | 0.327 | 0.162 | 0.231 | 0.117 | 1.15 |

| Specimen No. | Development factor (31° C.) (%) | ΔS($S_{2.0}$ (37° C.)-$S_{2.0}$ (31° C.)) (represented as common logarithms) | Haze | Wet adhesivity (Anti-peeling protecties) |
|---|---|---|---|---|
| 1 | 85 | 0.35 | 5 | A |
| 2 | 91 | 0.27 | 5 | A |
| 3 | 93 | 0.25 | 5 | A |
| 4 | 87 | 0.32 | 4 | A |
| 5 | 90 | 0.28 | 4 | A |
| 6 | 94 | 0.19 | 5 | A |
| 7 | 99 | 0.12 | 4 | A |

Amount of gelatin in emulsion layer in all specimens: 1.63 $g/m^2$
Amount of gelatin in protective layer in all specimens: 1.16 $g/m^2$
All amounts of substances are those contained in coating on one side of the support.

EXAMPLE 6

(1) Preparation of emulsion

The same surface photosensitive silver halide emulsion as preapared in Example 1 was used. However, the preparation of the internally fogged particle emulsion was conducted as follows:

Particles were formed in such a manner that the sensitivity thereof reached 1/100 or less of that of the emulsion of Example 1 by the process described in U.S. Pat. No. 2,592,250. The particles were then internally fogged by light. The praticles thus fogged were allowed to adsorb the mercapto compound B-1 of Example 1 to obtain an internally fogged silver chlorobromide emulsion B-2 (AgCl: 9 mol%) having an average particle diamenter of 0.30 μm.

(2) Preparation of emulsion coating composition 5 partis by weight of emulsion A (as silver content) and 1 part by weight (as silver content) of emulsion B-2 were mixed with each other. The same additives as used in Example 5 were added to the mixture thus obtained except that the molecular weight of polyacrylamide was 9,000 to obtain a coating composition.

(3) Preparation of coating composition for surface protective layer

A coating composition was prepared in the same manner as used in Exampler 5 except that the molecular weight of polyacrylamide was 9,000, and that polyoxyethylenic surface active agent I-3 was used.

(4) Preparation of coated specimens and various evaluation tests such as sensitometry These processes were conducted in the same manner as used in Example 5. The results are shown in Table 4.

TABLE 4

| Specimen No. | Amount of polyacryl amide (MW = 9,000) in emulsion layer ($g/m^2$) | Amount of dextran (MW = 68,000) in emulsion layer ($g/m^2$) | Amount of polyacryl amide (MW = 9,000) in protective layer ($g/m^2$) | Amount of dextran (MW = 68,000) in protective layer ($g/m^2$) | Rel. $S_{1.0}$ (31° C.) (represented as common logarithms) |
|---|---|---|---|---|---|
| 1 | — | — | — | — | 1.00 |
| 2 | — | — | 0.435 | 0.217 | 1.07 |
| 3 | 0.435 | 0.217 | — | — | 1.08 |
| 4 | 0.273 | 0.135 | 0.194 | 0.098 | 1.10 |

| Specimen No. | Development factor (31° C.) (%) | $\Delta S$ ($S_{2.0}$ (37° C.)-$S_{2.0}$ (31° C.)) (represented as common logarithms) | Haze | Wet adhesivity (Anti-peeling protecties) |
|---|---|---|---|---|
| 1 | 80 | 0.40 | 5 | A |
| 2 | 91 | 0.27 | 4 | A-B |
| 3 | 92. | 0.28 | 5 | A |
| 4 | 94 | 0.26 | 5 | A |

Amount of gelatin in emulsion layer in all specimens: 1.63 $g/m^2$
Amount of gelatin in protective layer in all specimens: 1.16 $g/m^2$
All amounts of substances are those contained in coating on one side of the support.

As can be seen in Table 4, the addition of polyacrylamide and dextran can improve the relative sensitivity, development factor and development temperature dependency of sensitivity with little or no deterioration of haze and wet adhesivity.

EXAMPLE 7

A sepcimen was prepared in the same manner as used in specimen N. 7 of Exmaple 5 except in that the polyethylenic surface active agent II-10 was replaced by II-31, polyacrylamide (Compound III-1) was replaced by polyacrylamide (Compound III-13) ($\overline{MW}$=45,000), and dextran ($\overline{MW}$=68,000) was replaced by dextran ($\overline{MW}$=60,000).

The specimen thus preapred was measured for sensitomery. As in Specimen 7, excellent results were obtained.

As apparent from the foregoing description, the present invention provides a silver halide photographic material which has improved sensitivity, development factor and development temperature dependency of sensitivity without deterioration of haze and wet adhesivity.

While the invention has been described in detail and with reference to specific embodiments thereof, it will be apparent to one skilled in the art that various changes and modifications can be made therein without departing from the spirit and the scope thereof.

What is claimed is:

1. A silver halide photographic material comprising at least one silver halide photographic emulsion layer disposed on at least one side of a support, wherein at least one of the silver halide photographic emulsion layer(s) contains a photosensitive silver halide emulsion containing silver iodide and an internally fogged silver halide emulsion, and at least one of the silver halide photographic emulsion layer(s) and an auxiliary layer(s) which is disposed on the same side of the support as that of the support having said emulsion containing silver iodide is a surface protective layer containing at least one polyoxyethylenic surface active agent selected from the group consisting of compounds represented by formula (I) and (II)

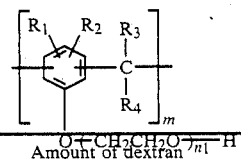

(I)

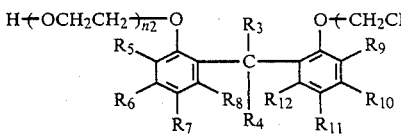

(II)

wherein $R_1$, $R_2$, $R_6$, $R_8$, $R_{10}$, and $R_{12}$ each represents a hydrogen atom, a substituted or unsubstituted alkyl group, aryl group alkoxy group, or aryloxy group, a halogen atom, an acyl group, an amido group, a sulfonamido group, a carbamoyl group, or a sulfamoyl group; $R_5$, $R_7$, $R_9$ and $R_{11}$ each represents a substituted or unsubstituted alkyl group, aryl group alkoxy group, or aryloxy group, a halogen atom, an acyl group, an amido group, a sulfonamido group, a carbamoyl group, or a sulfamoyl group; $R_3$ and $R_4$ each represents a hydrogen atom, a substituted or unsubstituted alkyl group, aryl group, or heterocyclic aromatic ring; or groups in at least one combination of $R_3$ and $R_4$, $R_5$ and $R_6$, $R_7$ and $R_8$, $R_9$ and $R_{10}$, and $R_{11}$ and $R_{12}$ are connected to each other to form a substituted or unsubstituted ring; $n_1$, $n_2$, and $n_3$ each represents the average polymerization degree of ethylene oxide within the range of from 5 to 50; and m represents an average polymerization degree of from 5 to 50.

2. A silver halide photographic material as in claim 1, wherein $R_1$, $R_2$, $R_5$, $R_6$, $R_7$, $R_8$, $R_9$, $R_{10}$, $R_{11}$ and $R_{12}$ each represents a substituted or unsubstituted alkyl group having from 1 to 20 carbon atoms, a substituted or unsubstituted aryl group having from 6 to 20 carbon atoms, a substituted or unsubstituted alkoxy group represented by the formula —$OR_{15}$ wherein $R_{15}$ represents a substituted or unsubstituted alkyl group having from 1 to 20 carbon atoms, a substituted or unsubstituted aryl group having from 6 to 20 carbon atoms, or a substituted or unsubstituted aralkyl group having from 7 to 20 carbon atoms, a halogen atom, an acyl group represented by the formula —$COR_{15}$, and amido group represented by the formula —$NR_{16}COR_{15}$, a sulfonamido group represented by the formula —$NR_{16}SO_2R_{15}$, a carbamoyl group represented by the formula

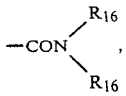

or a sulfamoyl group represented by the formula

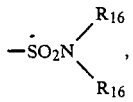

wherein $R_{15}$ is as defined above and $R_{16}$ is a hydrogen atom or an alkyl group having from 1 to 20 carbon atoms.

3. A silver halide photographic material as in claim 1, wherein $R_3$ and $R_4$ each represents an alkyl group having form 1 to 8 carbon atom.

4. A silver halide photographic material as in claim 1, wherein $R_3$ and $R_4$ each represents a 5- or 6-membered heterocyclic aromatic ring.

5. A silver halide photographic material as in claim 4, wherien said 5- or 6-membered heterocyclic aromatic ring has —O—, —NH—, or —S— in the ring.

6. A silver halide photographic material as in claim 1, wherein said ring formed by connecting $R_3$ and $R_4$, $R_5$ and $R_6$, $R_7$ and $R_8$, $R_9$ and $R_{10}$, and $R_{11}$ and $R_{12}$ is a 5- or 6-membered cycloalkyl group or an aryl group.

7. A silver halide photographic material as in claim 1, wherein $n_1$, $n_2$, and $n_3$ each is a number of from 5 to 30.

8. A silver halide photographic material as in claim 1, wherein the amount of the surface active agent is from 0.05 to 500 mg (one side) per $m^2$ of the photographic mterial.

9. A silver halide photographic material as in claim 8, wherein the amount of the surface active agent is from 0.01 to 500 mg per gram of silver.

10. A silver halide photographic material as in claim 1, wherein said photographic material further contains at least one compound selected from the group consisting dextran and polymers containing repeating units of formula (III) in at least one of the silver halide emulsion layer(s) and the auxiliary layer(s) of the photogrpahic material.

(III)

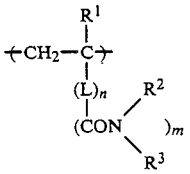

wherein $R^1$ represents a hydrogen atom or an alkyl group having from 1 to 6 carbon atoms; $R^2$ and $R^3$ each represents a hydrogen atom, or a substituted or unsubstituted alkyl, aryl, or aralkyl group having 10 carbon atoms or less; or $R^2$ and $R^3$ is bonded to each other to form a nitrogen-containing heterocyclic ring with the nitrogen atom in the formula: L represents a linking group having a valence of (m+1); n represents an integer of 0 or 1; and m represents an integer of 1 or 2.

11. A silver halide photographic material as in claim 10, wherien said nitrogen-containing heterocyclic ring contains at least one additional heterocyclic atom selected from the group consisting of an oxygen atom and a nitrogen atoms.

12. A silver halide photographic material as in claim 10, wherein L represetns an alkylene group having from 1 to 10 carbon atoms, an arylene group having from 6 to 10 carbon atoms and divalent groups obtained by bonding two or more of them with ether linkage, ester linkage, or amido linkage.

13. A silver halide photographic material as in claim 10, wherein said polymer is represented by formula (III)'

(III)'

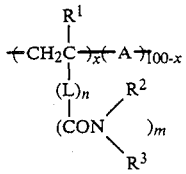

wherein $R^1$, $R^2$, $R^3$, L, m, and n are the same as defined for formula (III); x represents a molar percentage of from 70 to 100; and A represents a monomer unit of copolymerizable ethylenic unsaturated monomers.

14. A silver halide photographic material as in claim 10, wherein said polymer has a wight-average molecular weight of from 5,000 to 200,000.

15. A silver halide photographic material as in claim 10, wherein said dextran has weight average molecular weight of from 10,000 to 300,000.

16. A silver halide photographic material as in claim 10, wherein the amount of at least one of said polymer and dextran is from 5 to 50% by weight based on the total weight of the binder in the photographic emulsion.

17. A silver halide photographic material as in claim 1, wherien the internally fogged silver halide particulate has a compound represented by formula (IV) adsorbed thereon;

(IV)

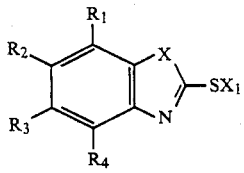

wherein X presents —O—, —NH—, or —S—; and $R_1$, $R_2$, $R_3$ and $R_4$ each represents a hydrogen atom or a group capable of substituting for hydrogen atom, and at least one of $R_1$, $R_2$, $R_3$ and $R_4$ is a substituted or unsubstituted alkyl group having from 1 to 13 carbon atoms or aryl group having from 6 to 13 carbon atoms which is bonded to the benzene ring directly or via a divalent linking group; $X_1$ represents a hydrogen atom or a cation which is able to make the molecule represente by formula (IV) neutral.

18. A silver halide photographic material as in claim 17, wherein the amount of the compound is from $1\times10^{-5}$ to $1\times10^{-1}$ mole per mole of internally fogged silver halide particulate.

19. A silver halide photographic naterial as in claim 1, wherien the sensitivty of the internally fogged silver halide emulsion is 1/10 times or less than that of the photosensitive silver halide emulsion.

20. A silver halide photographic material as in claim 1, wherein the photosensitive silver halide emulsion is a surface latent image type silver halide emulsion.

21. A silver halide photographic material as in claim 20, wherein the silver halide in the surface latent image type silver halide smulion is a compound selected from the group consisting of silver chloroiodide, silver iodobromide and silver chloroiodobromide.

22. A silver halide photographic material as in claim 20, wherein the content of silver iodide in the silver halide is from 1 to 30 mole%.

23. A silver halide photographic material as in claim 1, wherein the weight proportion of the content of silver of the photosensitive silver halide emulsion to that of the internally fogged silver halide emulsion is from 100/1 to 1/100.

24. A silver halide photographic material comprising at least one silver halide photographic emulsion layer disposed on at least one side of a support, wherein at least one of the silver halide photographic emulsion layers(s) contains a photosensitive silver halide emulsion which is a surface latent image type silver halide emulsion containing silver iodide, the content of silver iodide in the silver halide being from 1 to 30 mole%, and an internally fogged silver halide emulsion, the sensitivity of the internally fogged silver halide emulsion being 1/10 times or less than that of the photosensitive silver halide emulsion and wherein the weight proportion of the content of silver of the photosensitive silver halide emulsion to that of the internally fogged silver halide emulsion is from 100/1 to 1/100, and at least one of the silver halide photographic emulsion layer(s) and an auxiliary layer(s) which is disposed on the same side of the support as that of the support having said emulsion containing silver iodide is a surface protective layer containing at least one polyoxyethylenic surface active agent selected from the group consisting of compounds represented by formula (I) and (II)

(I)

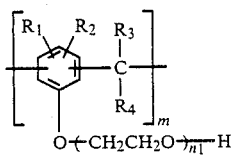

(II)

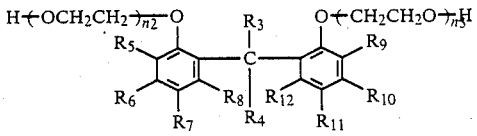

wherein $R_1$, $R_2$, $R_6$, $R_8$, $R_{10}$, and $R_{12}$ each represents a hydrogen atom, a substituted or unsubstituted alkyl group, aryl group alkoxy group, or aryloxy group, a halogen atom, an acyl group, an amido group, a sulfonamido group, a carbamoyl group, or a sulfamoyl group; $R_5$, $R_7$, $R_9$ and $R_{11}$ each represents a substituted or unsubstituted alkyl group, aryl group alkoxy group, or aryloxy group, a halogen atom, an acyl group, an amido group, a sulfonamido group, a carbamoyl group, or a sulfamoyl group; $R_3$ and $R_4$ each represents a hydrogen atom, a substituted or unsubstituted alkyl group, aryl group, or heterocyclic aromatic ring; or groups in at least one combination of $R_3$ and $R_4$, $R_5$ and $R_6$, $R_7$ and $R_8$, $R_9$ and $R_{10}$, and $R_{11}$ and $R_{12}$ are connected to each other to form a substituted or unsubstituted ring; $n_1$, $n_2$, and $n_3$ each represents the average polymerization degree of ethylene oxide within the range of from 5 to 50; and m represents an average polymerization degree of from 5 to 50.

* * * * *